US005533888A

United States Patent [19]

Belarde

[11] Patent Number: 5,533,888

[45] Date of Patent: Jul. 9, 1996

[54] APPARATUS FOR FORMING CONCRETE BARRIERS

[76] Inventor: John F. Belarde, 6327 - 114th Ave. SE., Renton, Wash. 98056

[21] Appl. No.: 203,630

[22] Filed: Feb. 28, 1994

Related U.S. Application Data

[60] Continuation-in-part of Ser. No. 900,704, Jun. 17, 1992, Pat. No. 5,290,492, which is a division of Ser. No. 571,458, Aug. 21, 1990, Pat. No. 5,173,309.

[51] Int. Cl.[6] ..... B28B 1/08; B28B 13/04

[52] U.S. Cl. ..... 425/64; 249/20; 264/33; 425/432; 425/456

[58] Field of Search ..... 425/62–64, 432, 425/456, 385; 249/15–17, 19–21, 155; 264/31–36, 333

[56] References Cited

U.S. PATENT DOCUMENTS

| | | | |
|---|---|---|---|
| 748,352 | 12/1903 | Dexter | 264/33 |
| 1,163,210 | 12/1915 | Bush | 264/33 |
| 2,150,830 | 3/1939 | Hallisy | 264/33 |
| 2,513,008 | 6/1950 | Davis | 249/20 |
| 3,245,648 | 4/1966 | Johansson et al. | 249/33 |
| 3,453,707 | 7/1969 | Johansson | 425/63 |
| 3,497,579 | 2/1970 | Barron | 264/33 |
| 3,562,056 | 2/1971 | Olson | 156/293 |
| 3,665,821 | 5/1972 | Walker | 425/62 |
| 3,740,176 | 6/1973 | Nilsson | 425/64 |
| 3,781,154 | 12/1973 | Herbert et al. | 425/329 |
| 3,792,133 | 2/1974 | Goughnour | 264/33 |
| 4,001,358 | 1/1977 | McNeill et al. | 264/33 |
| 4,075,300 | 2/1978 | Keller | 264/32 |
| 4,106,300 | 8/1978 | McNeill | 264/31 |
| 4,125,348 | 11/1978 | Martens | 425/64 |
| 4,152,382 | 5/1979 | Catenacci | 264/33 |
| 4,266,917 | 5/1981 | Godbersen | 425/64 |
| 4,314,798 | 2/1982 | Pettersson | 425/63 |
| 4,320,075 | 3/1982 | Nielson | 264/32 |
| 4,761,126 | 8/1988 | del Valle | 425/62 |
| 4,872,823 | 10/1989 | Howard | 425/64 |

FOREIGN PATENT DOCUMENTS

| | | | |
|---|---|---|---|
| 699148 | 11/1979 | U.S.S.R. | 249/20 |

OTHER PUBLICATIONS

*M–8100 Automated Slipformer,* Miller Formless Co., Inc., McHenry, IL., undated.

*Primary Examiner*—Richard L. Chiesa

*Attorney, Agent, or Firm*—Christensen O'Connor Johnson & Kindness

[57] ABSTRACT

A system for continuously forming a concrete structure that extends in a generally horizontal direction and has a predetermined cross-sectional configuration is provided. The system includes a frame, a first form, and a second form. The first and second forms are coupled to the frame and support at least a portion of the sides of the concrete structure being formed. The second form forms a pattern in one of the outside surfaces of the concrete. The first form may also form a pattern. The pattern includes concave and convex portions that extend other than just in the horizontal direction. The second form coacts with the first form to enclose an area having a cross-sectional configuration corresponding to the predetermined cross-sectional configuration of the concrete structure. The frame includes a side arm assembly that slidingly engages the outside of one or both of the forms.

29 Claims, 11 Drawing Sheets

APPARATUS FOR FORMING CONCRETE BARRIERS

Cross-Reference to Related Applications

This application is a continuation-in-part of application Ser. No. 07/900,704, filed Jun. 17, 1992, now U.S. Pat. No. 5,290,492 entitled Method for Forming Concrete Barriers, which is a divisional of application Ser. No. 07/571,458, filed Aug. 21, 1990, entitled Apparatus for Forming Concrete Barriers, now U.S. Pat. No. 5,173,309.

FIELD OF THE INVENTION

The present invention relates to an apparatus for continuously forming concrete structures, and more specifically to an apparatus for continuously forming concrete road barriers having a textured surface on at least one side thereof.

BACKGROUND OF THE INVENTION

Equipment for continuously forming concrete barriers of the type commonly referred to as "Jersey" barriers is well known. Such equipment, also known as automated slip formers, generally includes a slidable form or "mule" for defining the shape of the barrier, a hopper coupled to the mule through which concrete is delivered to the mule, and a drive assembly coupled to the mule and hopper for causing these elements, specifically the slidable mule, to move along a path extending next to the surface on which the barrier is to be erected. An exemplary piece of such slip forming equipment is manufactured by Miller Formless Company, Inc., of McHenry, Ill., and is identified by Model No. M-8800.

Known slip forming equipment is well adapted to continuously forming horizontally extending concrete traffic barriers having either smooth outer surfaces or outer surfaces having continuous, horizontally extending grooves, ridges, or other concave or convex surface textures. Unfortunately, known slip forming equipment is not adapted to forming horizontally extending concrete barriers having other than horizontal textures, specifically vertically extending, transversely extending, or other non-horizontally extending surface texturing. This limitation of known slip forming equipment is especially undesirable in areas where state and/or local construction codes require that at least one surface of the concrete road barrier include a non-horizontally extending surface texture. For instance, construction codes in the State of Washington require that, under certain circumstances, the outer surface of concrete barriers installed along the outer edges of bridges include substantially vertically extending striations. At present, such bridge barriers are formed and poured on a non-continuous, section-by-section basis, at a cost far in excess of that for continuously forming horizontally extending concrete barriers of similar height and thickness.

With respect to vertical striations, equipment is known for vertically slip forming concrete abutments, silos, and other structures characterized by vertically extending concrete walls. Accordingly, vertically extending grooves, ridges, or concave or convex surface textures can be placed in the structure according to the vertical direction of form movement. Such equipment is disclosed, for instance, in U.S. Pat. No. 3,453,707 to Johansson, and U.S. Pat. No. 4,314,798 to Pettersson. The Pettersson apparatus includes a yoke and a pair of leg assemblies attached to and extending downwardly from the yoke. The leg assemblies are spaced a predetermined distance from one another, and the apparatus includes means for moving the leg assemblies toward and away from one another. In use, two form halves are positioned between and supported by the leg assemblies. Concrete is then poured between the form halves, which are caused to move upwardly in a continuous manner by moving the yoke and leg assemblies upwardly. Although known apparatus for vertical slip forming may be satisfactorily employed in the fabrication of vertically extending walls, such apparatus are not adapted to form horizontally extending barriers, or vertically extending walls having other than vertically extending surface texturing.

In addition, surface texturing problems are compounded with respect to slip forming, wherein there is a desire or construction code requirement which stipulates that both sides of the concrete structure have a textured surface, the texture being other than horizontal striations. Such designs would generally include conventional concrete forming methods, wherein forms having the reverse of the textures are fixed in place and properly supported prior to placement of the wet concrete. In this regard, significant bracing including cross-tying between the two form structures is required to adequately support the concrete structure or barrier while the concrete is being poured. The same reinforcement must then be removed once the concrete has substantially cured.

Therefore, there exists a need for a concrete forming system that allows textured patterns to be placed on one or both sides of a substantially vertical extending surface, such as the sides of a concrete barrier. For efficiency and ease of construction, it is beneficial that the forming system incorporate a movable concrete placing system, wherein wet concrete is placed between forms through a drive means, as the drive means continually progresses along the form structure.

SUMMARY OF THE INVENTION

The present invention provides a system for continuously forming a concrete structure having a predetermined cross-sectional configuration, which extends in an elongated path, and includes at least one outer surface having a textured pattern, the pattern including concave or convex portions that extend other than parallel to the elongated path of the form structure. The system of the present invention includes a frame attached to a drive system, a first and second form assembly, and a first and second support assembly.

In the first and second embodiments of the present invention, the first form assembly is coupled to the frame and is designed to support at least a portion of one side of the concrete structure being formed. The second form assembly is designed to support an opposite side of the concrete structure, the second form assembly generally leaving the reverse image of a desired pattern (other than a horizontal pattern) to be permanently placed in the outer surface of the concrete structure. The second form assembly is designed to coact with the first form assembly so as to enclose an area having a cross-sectional configuration corresponding to the predetermined cross-sectional configuration of the concrete structure.

In accordance with the first and second embodiments, in practice, the second form assembly is erected prior to the formation of the concrete structure, remains standing during the formation of the structure, and typically is not disassembled until after the concrete composing the concrete structure has substantially cured. The drive means is coupled to the frame and the frame is coupled to the first form assembly. The drive means causes the first form assembly to move along the path in which the concrete structure is formed while concrete is simultaneously being placed between the first and second form assemblies. The first form assembly is coupled to the frame and is designed to slidingly engage the second form assembly as the first form assembly is caused to move along the path. A support also coupled to the frame supports the second form assembly relative to the first form assembly, as the drive assembly moves along the path so as to permit the second form assembly to coact with the first form assembly to enclose the area in which the wet concrete is poured to form the concrete structure.

In the third embodiment of the present invention, both the first form assembly and the second form assembly support opposite sides of the concrete structure, each form assembly including a pattern on its inner surface which is preferably other than horizontal. The first and second form assemblies enclose an area having a crosssectional configuration corresponding to the predetermined cross-sectional configuration of the concrete structure. In practice, the first and second form assemblies are erected prior to the placement of wet concrete forming the concrete structure, remain standing during the formation of the concrete structure, and typically are not disassembled until after the concrete structure has substantially cured. In this regard, the frame coupled to the drive means includes two opposing supports for supporting the first and second form assemblies as the drive means moves along the elongated path and places wet concrete between the first and second form assemblies. Accordingly, the support assemblies on either side of the form structure slidingly engage the first and second form assemblies as the drive system moves in the elongated direction of the concrete barrier thereby supporting the first and second form assemblies relative to one another so as to enclose and define the area in which the concrete structure is formed.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 2A:
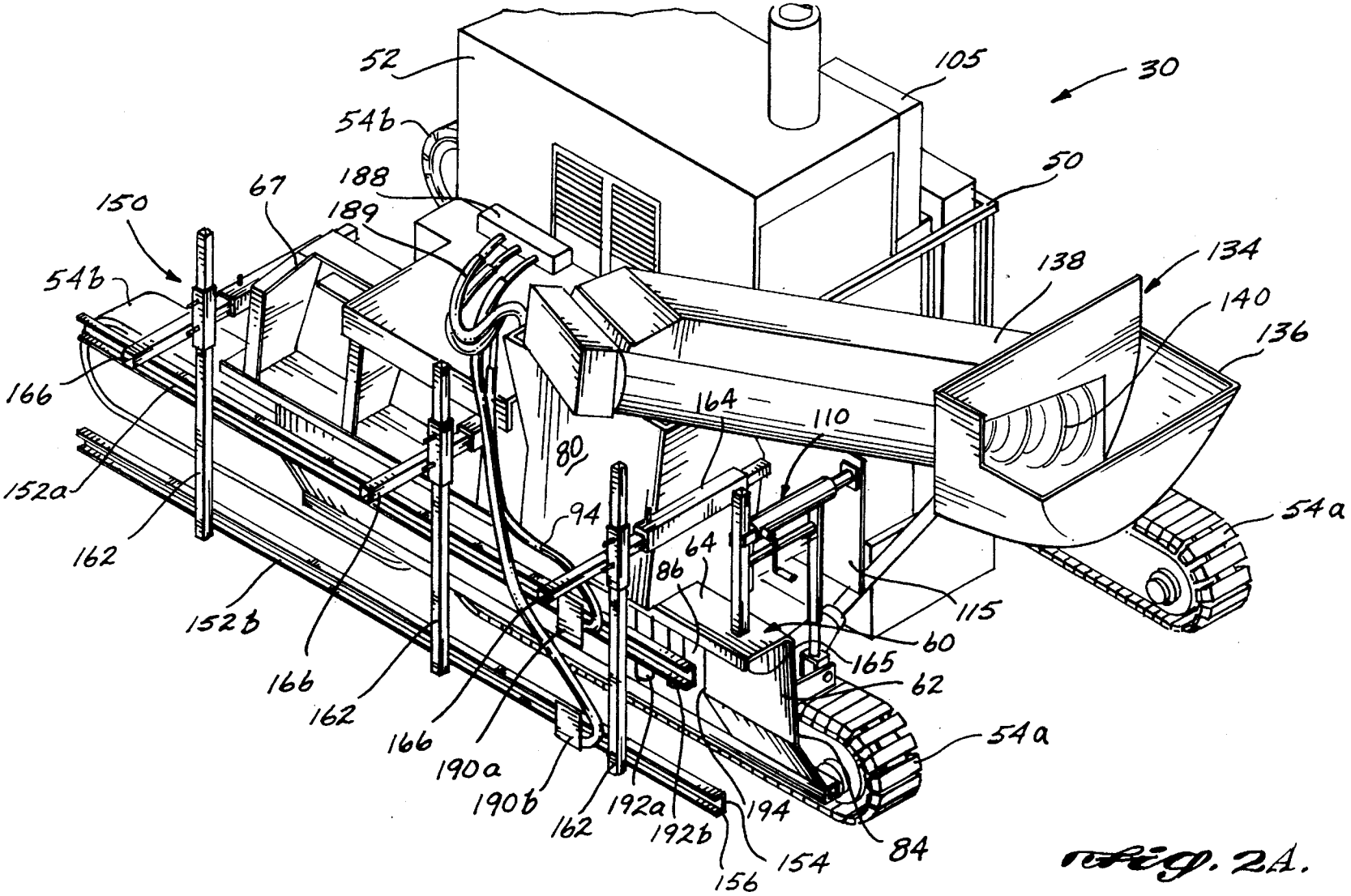
FIG. 2A is a perspective view of the side of the slip former of the first embodiment on which a mule and side arm support assembly that form part of the slip former are positioned.
Figure 2B:
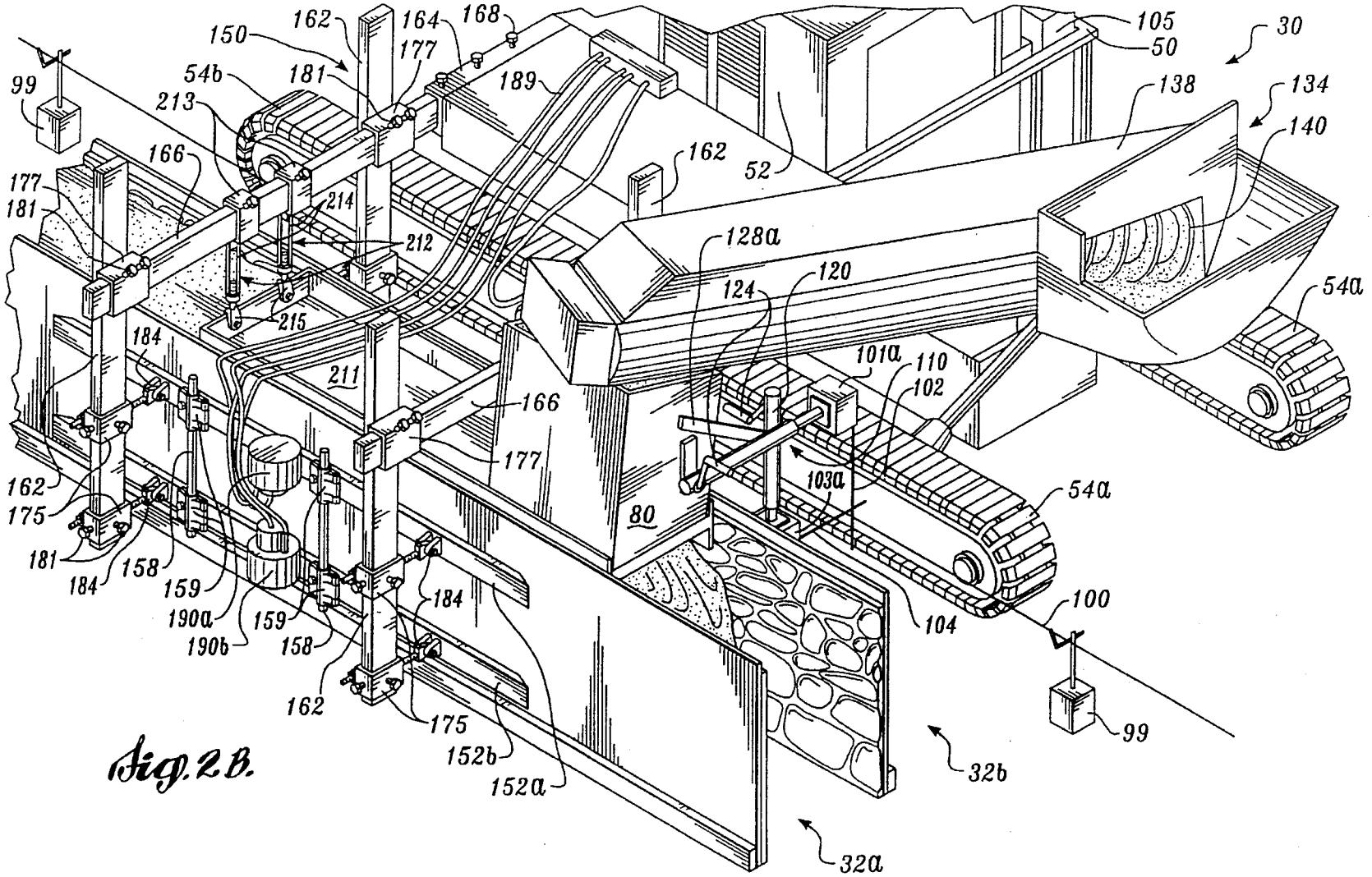
FIG. 2B is a perspective view of the side of the slip former of the third embodiment in which the side arm support assembly that forms part of the slip former is positioned.
Figure 3A:
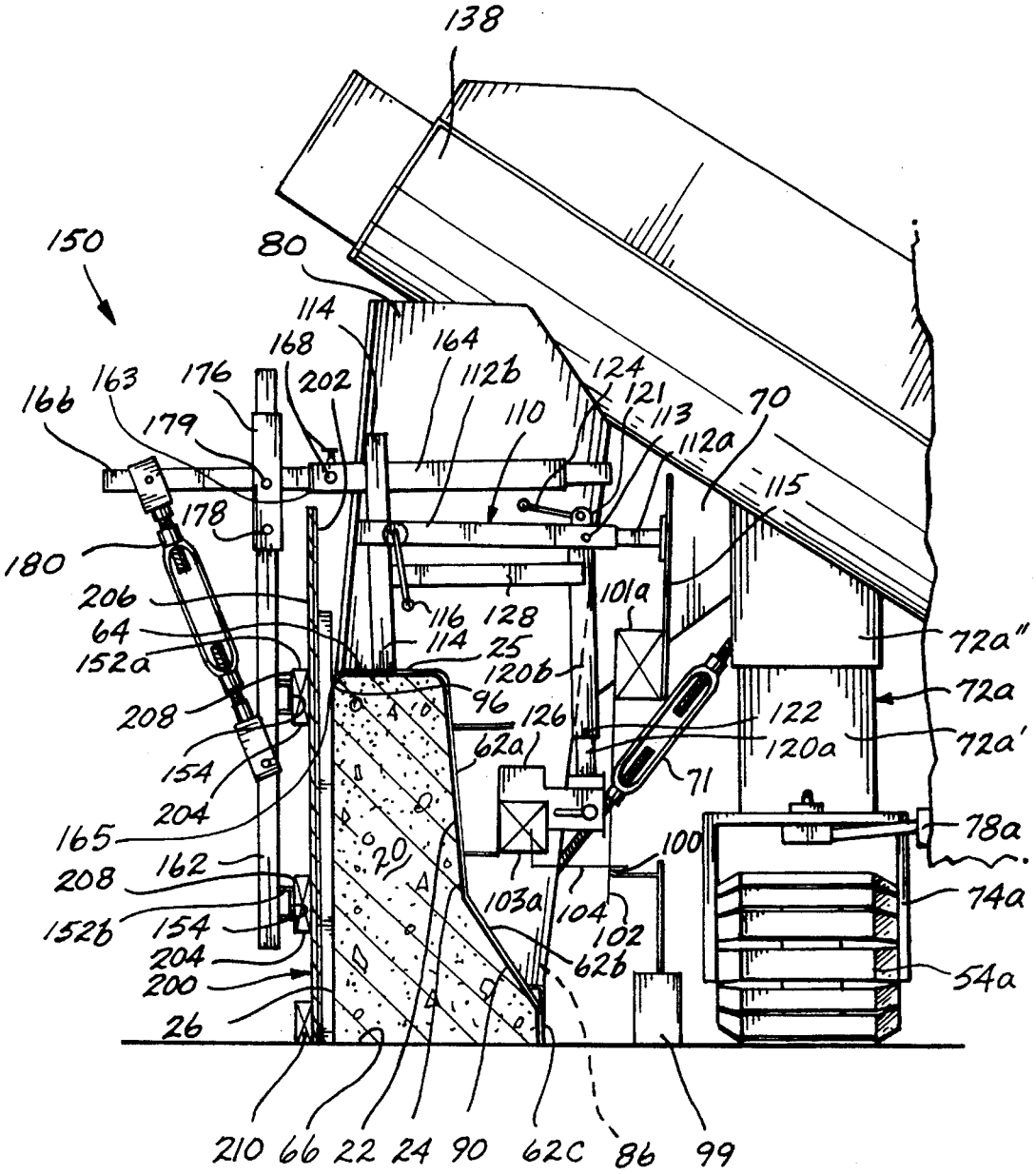
FIG. 3A is an end elevation view of the first embodiment of the present invention, showing the operative association between the mule and the elongated form, with the concrete structure formed by the present invention being shown in the space enclosed within the mule and form.
Figure 3B:
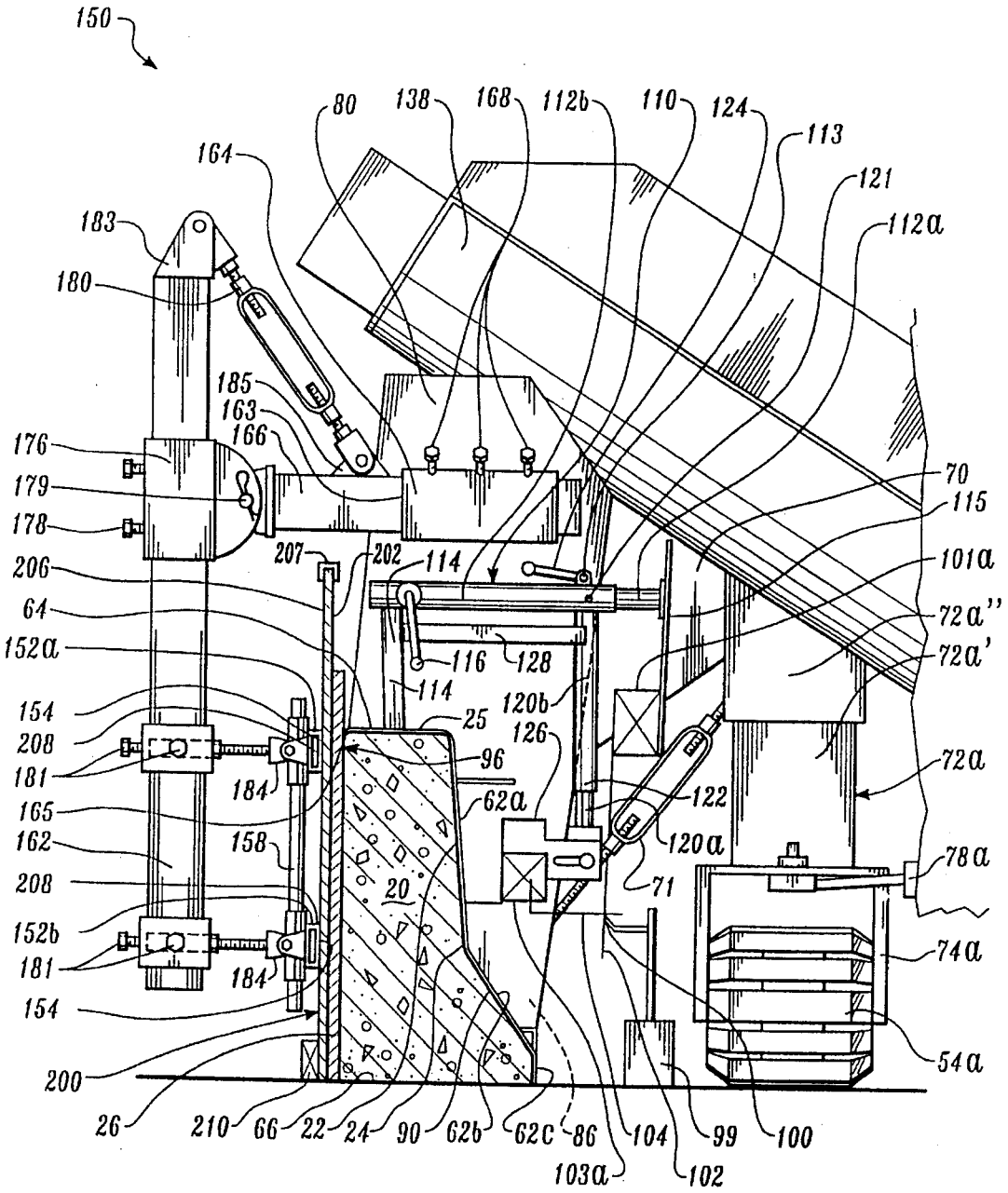
FIG. 3B is an end elevation view of the second embodiment of the present invention showing the operative association between the mule and the elongated form, with the concrete structure formed by the present invention being shown in the space enclosed within the mule and form.
Figure 3C:
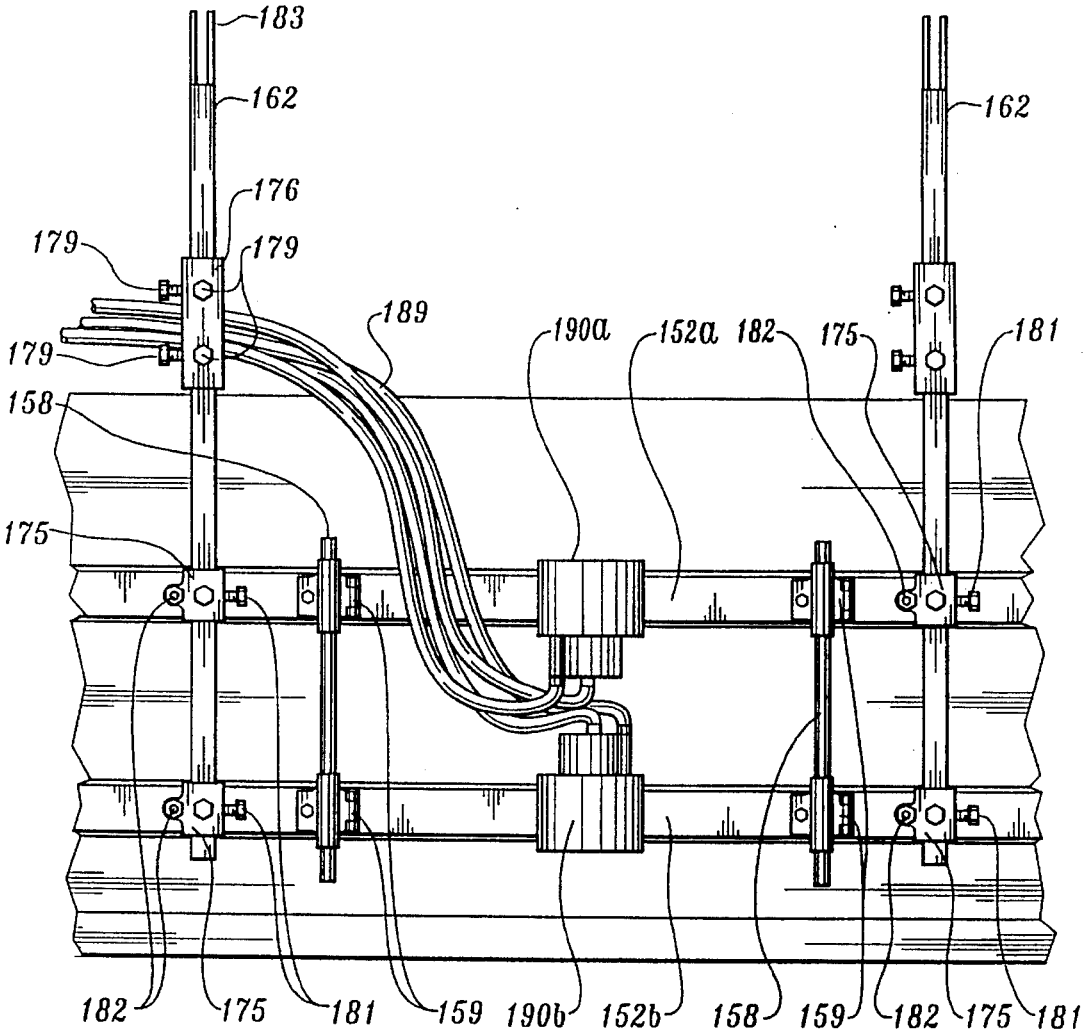
FIG. 3C is a side elevational view of the side of the slip former of the second embodiment of the present invention showing the operative association between the components of the arms of the pair of support assemblies and the elongated form.
Figure 3D:
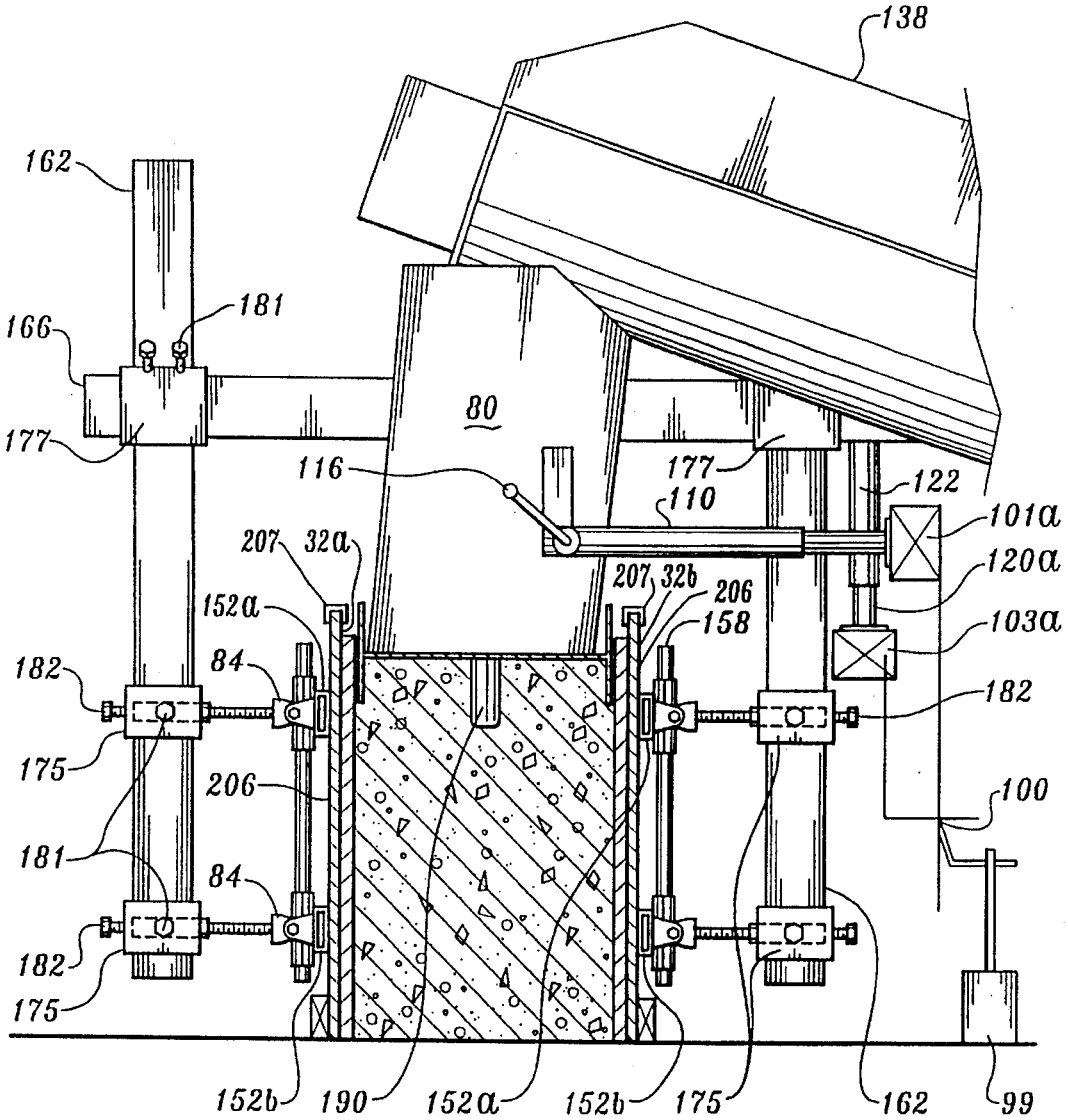
FIG. 3D is an end elevation view of the third embodiment of the present invention, showing the operative association between the first and second forms, and the drive system, with the concrete structure formed by the present invention being shown in the space enclosed between the first and second forms.

Three preferred embodiments of the present invention are described. To the extent practicable, in order to avoid confusion, the same reference numbers are used for the same parts in the views of embodiments of the invention shown in the drawings. One of the embodiments of the invention is best shown in FIGS. 2A and 3A, the second is best shown in FIGS. 3B and 3C, and the third embodiment is best shown in FIGS. 2B and 3D. The first and second embodiments are designed to create a concrete barrier having a textured surface on one side, and the third embodiment is designed to create a concrete barrier having a textured surface on both sides.

Figure 1:
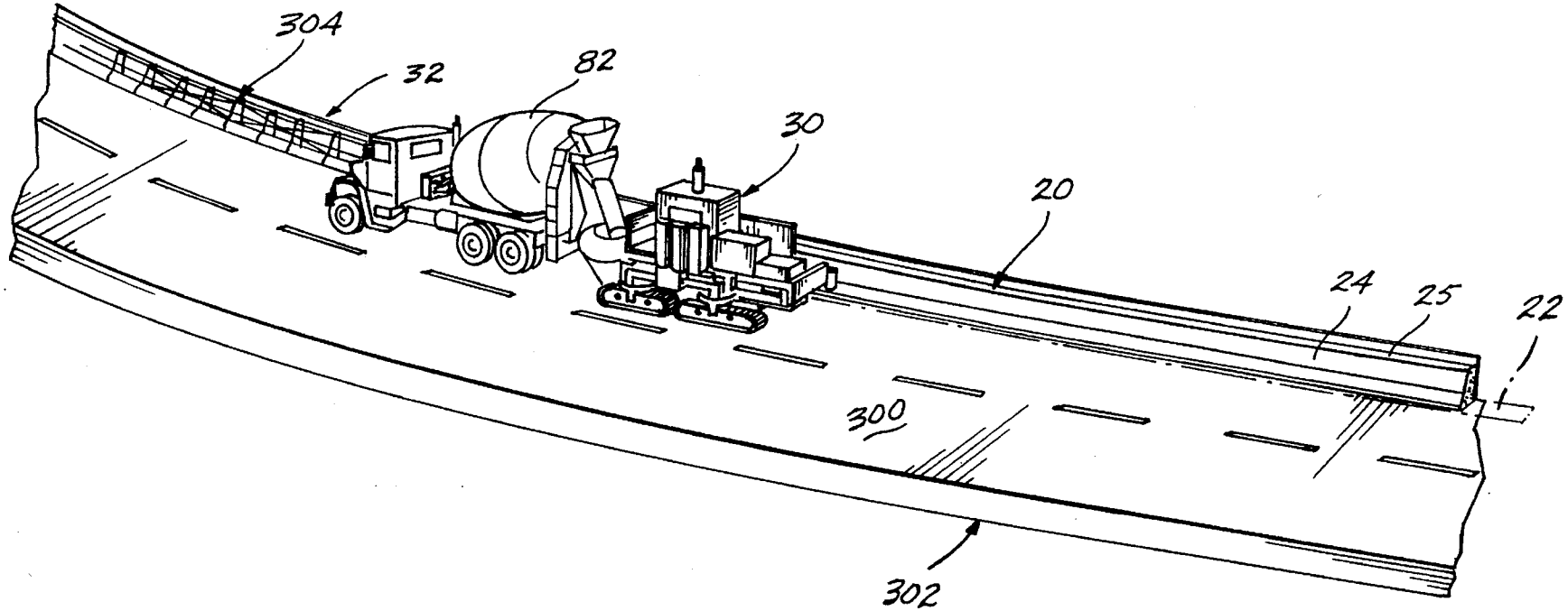
FIG. 1 is a perspective view of a horizontally extending concrete structure being formed by the system of the first and second embodiments of the present invention illustrating the slip former, elongated form, and a concrete supply truck for delivering concrete to the slip former.

Referring to FIGS. 1, 3A and 3B, the first and second embodiments of the present invention comprise a system for continuously forming a unitary concrete structure 20 which extends along a fiat, elongated path 22. The concrete structure 20 includes a slip formed surface 24, an upper surface 25, and a textured surface 26 (FIGS. 3A and 3B) positioned opposite the slip formed surface 24. As described in greater detail hereafter, the textured surface 26 has a pattern formed therein that includes portions which extend other than just parallel to the path 22 along which the structure 20 is formed. The types of concrete structures 20 that may be formed with the present invention include traffic barriers positioned between opposing lanes of traffic (e.g., "Jersey" barriers), curbs, traffic barriers positioned at the outer edges of bridges and roadways, and other horizontally extending structures using concrete as the structural material. Thus, the path 22 along which structure 20 is formed includes the median divider strip in a road, the edge of a road, or the edge of the top surface of a bridge. In addition, with certain modifications, the present system may be used to form continuous, vertically extending structures having a textured surface including patterns which extend other than just in the vertical direction. It will be readily apparent to those skilled in the art that while the first and second embodiments are being described with respect to a textured pattern on one side of the barrier and the third embodiment of the present invention being described with respect to a textured pattern on both sides of the barrier, the present invention would be equally applicable to barriers having alternating textured pattern and smooth (i.e., void of any texture) surfaces.

The slip forming system of the present invention includes a slip former 30 and, in the first and second embodiments, an elongated form 32, which supports one side of the concrete structure 20, and in the third embodiment, first and second elongated forms 32a and 32b, which support both sides of the concrete structure 20. The elongated forms define the pattern on the textured surface 26 and/or 27 of the structure.

Referring to FIGS. 1 through 4, the slip former 30 is a modified version of a conventional slip former of the type used to slip form unitary, horizontally extending concrete structures, such as traffic barriers. One such slip former is manufactured by Miller Formless Company, Inc., of McHenry, Ill., and is identified by Model No. M-8800. As used herein, to "slip form" means to continuously pour an elongated concrete structure which extends along a predetermined path using a form for supporting either side of a concrete structure while wet concrete is poured between the form structures, the form structures defining the configuration of the concrete structure.

As described in greater detail below, the slip former 30 of the invention differs from conventional slip formers of the type referred to above in that it includes a side arm assembly 150. The side arm assembly 150 in the first and second embodiments includes a modified mule 60 for supporting one side of the concrete structure 20 and a support for supporting a single elongated form 32, which supports and defines the texture of the second side of the concrete structure. In the third embodiment the side arm assembly 150 has two supports for supporting first and second elongated forms 32*a* and 32*b*, which support and define the textures of both sides of the concrete structure.

The slip former 30 of the first and second embodiments of the present invention includes a frame 50, a motor 52 supported on the frame 50, and two pairs (front and rear) of endless tracks 54*a* and 54*b*, which are also attached to the frame 50. As discussed in greater detail hereinafter, the front pair of tracks 54*a* is coupled to a front steering mechanism 78*a*, which causes the front pair of tracks to move simultaneously to the fight and to the left independently of the rear pair of tracks 54*b*. The rear pair of tracks 54*b* is coupled to a rear steering mechanism 78*b*, which causes the rear pair of tracks to move simultaneously to the right and to the left independently of movement of the front pair of tracks. Steering mechanism 78*a* and 78*b* are controlled by a control system 98 (FIG. 4), which is discussed in greater detail below. The endless tracks 54*a* and 54*b* are coupled to the motor 52 by conventional transmission (not shown) and are adapted to cause the slip former 30 to move back and forth along the path 22 on which the concrete structure 20 is formed.

In the first and second embodiments of the present invention, the slip former 30 additionally includes the mule 60, which defines the shape of at least one, and typically two, surfaces of the concrete structure 20, and temporarily supports portions of the structure during the formation thereof, as discussed hereafter. Specific size, shape, and design of the mule 60 will vary as a function of the size, shape, and surface configuration of the concrete structure 20 to be formed. The slip former of the first and second embodiments of the present invention illustrated in FIG. 2A includes a mule 60 designed for use in forming a traffic barrier positioned along the outer edge of a bridge. The mule 60 provides the form surface for one side and the top of the concrete barrier 20.

The mule 60 of the first and second embodiments includes a side wall 62 and an upper wall 64 integral with the upper edge of the side wall 62. As best shown in FIG. 3, the side wall 62 includes an upper portion 62*a*, an intermediate portion 62*b* integral with the lower end of the upper portion, and a lower portion 62*c* integral with the lower end of the intermediate portion. The upper portion 62*a* extends downwardly and slightly outward from the upper wall 64 so that the included angle between the inner surfaces of upper wall 64 and the upper portion 62*a* is about 95°. The intermediate portion 62*b* extends downwardly and outwardly from the upper portion 62*a* so that the included angle between the outer surfaces of the upper portion 62*a* and the intermediate portion 62*b* is about 120°. The lower portion 62*c* extends downwardly from the intermediate portion 62*b* so as to extend perpendicular to the surface 66 (FIGS. 3A and 3B) on which concrete structure 20 is formed.

In the exemplary first and second embodiments of the present invention, the upper portion 62*a* has a length of 20", the intermediate portion 62*b* has a length of 13", and the lower portion 62*c* has a length of 4", all as measured along the height of the side wall, as seen in cross section in FIGS. 3A and 3B. The upper wall 64 extends parallel to the surface 66 and has a width corresponding to that of the upper surface 25 of the concrete structure 20, e.g., about 15". Both the side wall 62 and the upper wall 64 extend horizontally for a predetermined length, e.g., about 10', along one side of the slip former 30. In the first and second embodiments of the present invention illustrated in FIGS. 1, 2A, 3A, and 3B, the inner surfaces of the side wall 62 and the upper wall 64 are smooth. However, in the event it is desirable to provide one or more grooves in the slip form surface 24 or the upper surface 25, which extend along the length of the concrete structure 20, the side wall 62 and/or the upper wall 64 may include one or more inwardly projecting members (not shown) attached to (or integral with) the inside surfaces of these walls 62 and 64.

The mule 60 also includes a support structure 67 (FIG. 2A) coupled to the side wall 62 and the upper wall 64 for preventing the walls, particularly the side wall 62, from deflecting under a load of wet concrete to be poured into the space defined by the walls. The specific design of the support structure 67 may vary significantly, so long as the support structure is capable of preventing the above-noted deflection of the walls 62 and 64 of the mule 60. In the exemplary first and second embodiments, the support structure 67 is made from a plurality of steel plates shaped and attached together in an 1-beam-like configuration. The mule 60 is coupled to the frame 50 of the slip former 30 by a rigid member 70 (FIGS. 3A and 3B), which is attached to the frame 50 and to the support structure 67. Thus, movement of the slip former 30 along the path 20 is transmitted to the mule 60 via the rigid member 70 and the support structure 67. The coupling causes the mule 60 to move with the remainder of the slip former 30.

The rigid attachment of the mule 60 to the frame 50 of the slip former 30 is further achieved by a plurality of turnbuckles 71, only one of which is shown in FIGS. 3A and 3B. The lower ends of the turnbuckles 71 are attached to the mule 60 and the upper ends of the turnbuckles are attached to a portion of the frame 50 such that the turnbuckles extend at about a 45° angle relative to the surface 66 on which the slip former 30 moves.

Figure 4:
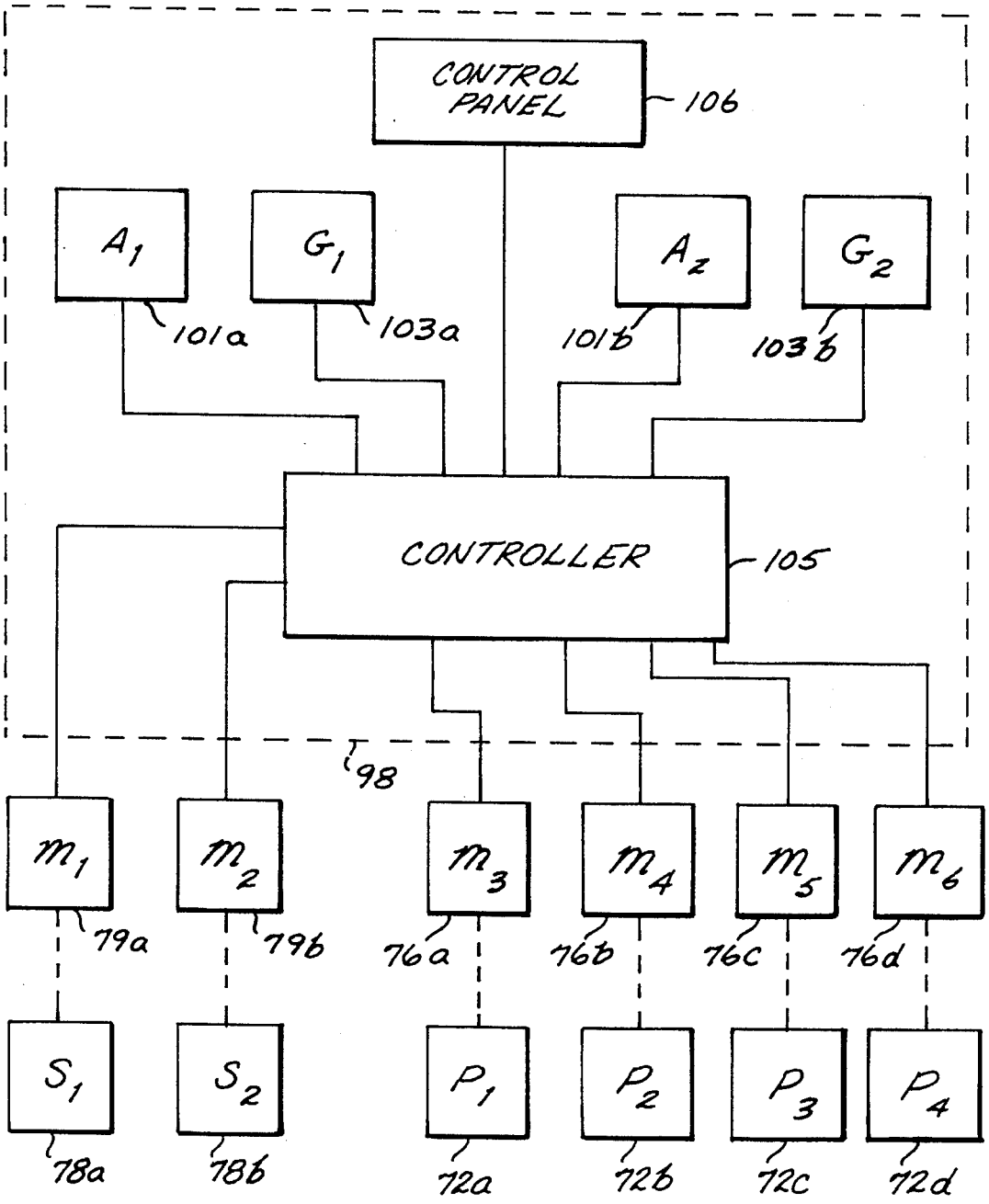
FIG. 4 is a schematic, block diagram illustration of the system for adjusting the position of the mule relative to the path along which the concrete structure is to be formed.

Referring to FIGS. 3A, 3B, and 4, the slip former 30 additionally comprises a plurality of hydraulic pistons 72*a*, 72*b*, 72*c*, and 72*d*, each of which is associated with a corresponding one of the two pairs of endless tracks 54*a* and 54*b*. FIGS. 3A and 3B illustrate one of the pistons. As shown in these figures, each piston 72*a* includes an inner member 72*a'* which is slidably mounted in an outer member 72*a"*. The pistons are constructed so that the overall length of the piston changes as a function of the quality of hydraulic fluid supplied to the piston. The bottom end of the illustrated piston 72*a* is coupled to a track 54*a* by a U-shaped bracket 74*a*, and the upper end of the piston 72*a* is coupled with frame 50 of slip former 30. The illustrated piston 72*a* extends vertically upward from the bracket 74*a* and supports approximately a quarter of the weight of the slip former 30. The remaining pistons 72*b*, 72*c*, and 72*d* are similarly constructed and connected between frame 50 and associated ones of tracks 54*a* or 54*b*. As illustrated in FIG. 4, each piston 72*a*, 72*b*, 72*c*, and 72*d* is associated with a corresponding respective hydraulic motor 76*a*, 76*b*, 76*c*, and 76*d* for supplying hydraulic fluid to, and exhausting hydraulic fluid from, the associated piston 72 as a function of the instructions contained in a control signal provided to the hydraulic motor by control system 98, as discussed in greater detail hereafter. The hydraulic motors 76 are conventional hydraulic motors of the type widely used in hydraulic systems.

As illustrated in FIG. 4, the slip former 30 further includes conventional hydraulic steering mechanism 78*a* and 78*b* for causing the front pairs of tracks 54*a* and 54*b*, respectively, to move to the fight and left. Inasmuch as steering mechanisms 78*a* and 78*b* are widely used to control the direction of travel of the tracks of conventional slip formers 30, such steering mechanisms are only schematically illustrated in FIG. 4. As will be appreciated by those skilled in the art, the steering mechanism 78*a* and 78*b* change the direction of travel of track pairs 54*a* and 54*b*, respectively, as a function of the hydraulic fluid pressure provided to the steering mechanisms.

The slip former 30 additionally comprises hydraulic motors 79*a* and 79*b* for supplying hydraulic fluid to, and exhausting hydraulic fluid from, the steering mechanisms, respectively. The hydraulic motors 79*a* and 79*b* are conventional hydraulic motors of the type widely used in hydraulic systems. As discussed in greater detail hereafter, the hydraulic motors 79*a* and 79*b* provide pressurized hydraulic fluid to, or exhaust pressurized hydraulic fluid from, the steering mechanism 78*a* and 78*b*, respectively, as a function of instructions contained in control signals provided to the hydraulic motors by the control system 98.

The mule 60 includes a hopper 80 through which wet concrete is delivered from a supply truck 82 (FIG. 1 ) to the space 90 enclosed by the side wall 62, the upper wall 64, and the elongated form 32, the physical relation of the latter to the walls 62 and 64 being discussed in greater detail hereafter. The hopper 80 is attached to the side wall 62 and the upper wall 64 of the mule 60 near, i.e., about 2 feet back from, the leading edge 84 of the mule 60. The hopper 80 projects upwardly from the upper wall 64 of the mule 60 and includes a hollow interior 86 (FIG. 2A), which is coupled with the space 90 via an opening 94 (FIG. 2A) provided in the side wall 62 and the upper wall 62 of the mule 60. The opening 94 extends horizontally a selected distance, e.g., about 2.5 feet, along the length of the mule 60.

The mule 60 differs from the mules of conventional slip forming equipment in that the mule 60 comprises only a side wall 62 and an upper wall 64. The mules of conventional slip formers include a second side wall positioned opposite the side wall 62; the mule 60 of the invention includes an opening in place of the second side wall, which is filled by the elongated form 32 in the manner described below.

The slip former 30 also includes a steering control system 98 (FIG. 4) for controlling the position of the slip former 30, and hence the mule 60, which is attached thereto, relative to the path 22, by controlling the height of the pistons 72a, 72*b*, 72*c*, and 72*d*, and the position of the steering mechanism 78*a* and 78*b*. The control system 98 includes a plurality of string line supports 99 (FIGS. 2B, 3 A, 3B and 3D) for supporting a string line 100 adjacent the path 22. The supports 99 and the string line 100 are positioned adjacent the path 22 prior to the formation of the concrete structure 20, such that when the slip former 30 travels next to the path 22, the supports 99 and the string line 100 pass between the mule 60 (in the first and second embodiments) and the tracks 54. The supports 99 and the string line 100 are additionally positioned so that the string line extends parallel to, and is spaced a predetermined distance above, the path 22, along which the concrete structure 20 is to be erected.

The control system 98 also includes a pair of alignment sensors 101*a* and 101*b* for providing an output signal containing information which varies as a function of the extent of movement of the slip former 30 to the right or to the left (as seen in FIGS. 3A, 3B and 3D) of the string line 100. The alignment sensors 101*a* and 101*b* each include a vertically oriented wand 102, illustrated in conjunction with one of the sensors 101*a* in FIGS. 3A, 3B and 3D, positioned so as to slightly engage the left side (as seen in FIGS. 3A, 3B and 3D) of string line 100. The wands 102 are spring biased and change position relative to the alignment sensors 101*a* and 101*b* to which they are attached in accordance with changes in the lateral position of the slip former 30 relative to the string line 100, while remaining in sliding engagement with the string line 100. The information contained in the output signal of the alignment sensors 101*a* and 101*b* varies as a function of changes in movement of wands 102 relative to the alignment sensors 101*a* and 101*b*. Thus, the sensors sense horizontal deviations of the slip former 30 from the path defined by the string line 100.

The control system 98 further includes a pair of grade sensors 103*a* and 103*b* for providing an output signal containing information which varies as a function of vertical changes in movement of the slip former 30 relative to string line 100. The grade sensors 103*a* and 103*b* each include a horizontally oriented wand 104, illustrated in conjunction with one of the grade sensors 103*a* in FIGS. 3A, 3B and 3D, positioned so as to slightly engage the upper side (as seen in FIGS. 3A, 3B and 3D) of the string line 100. The wands 104 are spring biased and change position relative to the grade sensors 103*a* and 103*b* to which they are attached in accordance with changes in the vertical position of the slip former 30 relative to the string line 100 while remaining in sliding engagement with the string line 100. The information contained in the output signals of the grade sensors 103*a* and 103*b* varies as a function of changes in movement of the wands 104 relative to the grade sensors.

The control system 98 also includes a controller 105 (FIG. 4) for processing the output signals provided by the alignment sensors 101*a* and 101*b* and the grade sensors 103*a* and 103*b* generating control signals for the hydraulic motors 76*a*, 76*b*, 76*c*, 76*d*, and 79*a* and 79*b*. These control signals cause the hydraulic motors 76*a*, 76*b*, 76*c*, 76*d*, and 79*a* and 79*b* to supply pressurized fluid to, or exhaust pressurized fluid from the pistons 72*a*, 72*b*, 72*c*, and 72*d* and the steering mechanism 78*a* and 78*b*, respectively, such that mule 60 remains in a predetermined position relative to the string line 100, and hence to the path 22. Thus, the controller 105 is coupled to the alignment sensors 101*a* and 101*b*, the grade sensors 103*a* and 103*b*, the hydraulic motors 76*a* , 76*b*, 76*c*, and 76*d*, and the hydraulic motors 79*a* and 79*b*. Preferably, the controller 105 comprises a conventional microprocessor (not shown) which is programmed in a known manner to generate the control signals provided to the hydraulic motors 76*a*, 76*b*, 76*c*, and 76*d*, and 79*a* and 79*b* required to maintain the slip former 30, and hence the mule 60, in predetermined spaced relation to the string line 100. The specific steps of the software used by the controller 105 are not set forth herein inasmuch as they can be readily generated by one of ordinary skill in the art.

The control system 98 further includes a control panel 106 for permitting a user of the slip former 30 to direct the controller 105 to cause the hydraulic motors 76*a*, 76*b*, 76*c*, 76*d*, and 79*a* and 79*b* to operate and cause the pistons 72*a*, 72*b*, 72*c*, and 72*d* to raise or lower the position of the part of the slip former 30 supported on the pistons 72*a*, 72*b*, 72*c*, and 72*d*, and/or cause the steering mechanism 78*a* and 78*b* to move the track pairs 54*a* and 54*b* to the right and/or to the left.

The slip former 30 additionally includes two support mechanisms 110 (FIGS. 2A, 2B, 3A, 3B and 3D), each for adjusting the position of an associated alignment sensor 101 and an associated grade sensor 103. That is, each support mechanism 110 (FIGS. 3A, 3B and 3D) adjusts the position of an alignment sensor 101*a* and a grade sensor 103*a*. A support mechanism 110 is provided at each end of the slip former 30. For clarity of illustration, only the support mechanisms 110 adjacent the front of the slip former 30 is shown in FIGS. 2A and 2B.

A similar support mechanism 110 is included in the first, second and third embodiments of the invention, changed only as required by the supporting structure. Each support mechanism 110 comprises a horizontally extending, telescopic member 112, which includes an inner member 112*a*, and an outer member 112*b* that surrounds and slidably engages the inner member 112*a*. A set screw 113 or other securing means is provided for releasably securing the outer member 112*b* in a selected axial position relative to the inner member 112*a*. The support mechanisms 110 of the first and second embodiments of the invention (FIGS. 2A, 3A and 3B) also include a vertically extending member 114, which is attached to and projects upwardly from the upper wall 64 of the mule 60. The vertically extending member 114 is coupled to, and supports, the outer end of the outer member 112*b*. In the third embodiment (FIGS. 2B and 3D) the outer member 112 is affixed to the leading or front wall of the hopper 80. The support mechanism 110 of the first and second embodiments further includes a plate 115, which is attached to the inner end (right end as seen in FIGS. 3A, 3B and 3D) of the inner member 112*a* so as to lie perpendicular to the surface 66 on which the slip former 30 is supported, and so that the plane of the plate 115 lies parallel to inner surface 202 of the elongated form 32. As illustrated in FIGS. 3A, 3B and 3D, the plate 115 supports an alignment sensor 101*a* or 101*b* so that the sensor wand 102 slidingly engages the string line 100. The horizontally extending telescopic member 112 includes an adjustment mechanism 116, such as a rack-and-pinion drive assembly (not shown), which is used to move the inner member 112*a* in and out relative to the outer member 112*b*.

The support mechanism 110 further comprises a vertically extending telescopic member 120, which includes an inner member 120*a* and an outer member 120*b*. The outer member 120*b* surrounds and slidably engages the inner member 120*a*. The upper end of the outer member 120*b* is attached by welding or other means to the outer member 112*b* of the horizontally extending telescopic membrane 112 adjacent the innermost end (i.e., the fight end as seen in FIGS. 3A, 3B and 3D) of the outer member 112*b*. The vertically extending telescopic member 120 includes a set screw 122 or other means for fixing the inner member 120*a* in selected axial relation with respect to the outer member 120*b*. The vertical extending telescopic member 120 includes an adjustment mechanism 124 (FIGS. 3A, 3B and 3D), such as a rack-and-pinion drive assembly (not shown) for moving the inner member 120*a* up and down relative to the outer member 120*b*.

The support mechanism 110 of the first and second embodiments of the invention (FIGS. 2A, 3A and 3B) further includes an L-shaped bracket 126 attached to the bottom end of inner member 120. The bracket 126 supports a grade sensor 103*a* or 103*b* so that the wand 104 of the grade sensor is positioned to slidingly engage the string line 100. The support mechanism 110 of the first and second embodiments also includes a horizontally extending member 128, one end of which is coupled to a mid-length portion of the vertical member 114 and the other end of which is coupled to outer member 120*b* somewhat below (e.g., 6 inches below) the upper end 121 of the outer member 120*b*. The horizontally extending member 128 adds stiffening to the support mechanism. The third embodiment (FIGS. 2B and 3C) includes an inclined stiffening member 128*a* that extends from the hopper 80 to the outer member 120*b* of the vertically extending telescopic member 120.

Thus, as discussed hereinafter in connection with the description of the operation of the present invention, the appropriate manipulation of the various elements of the support mechanism 110 allows the horizontal and vertical position of alignment sensors 101*a* and 101*b* and grade sensors 103*a* and 103*b* to be adjusted as desired.

The slip former 30 also includes transport assembly 134 for receiving wet concrete from a supply truck 82 (FIG. 1 ) positioned adjacent the slip former 30, and for transporting the wet concrete up and into the hopper 80. The transport assembly 134 includes an open top chamber 136 for receiving wet concrete supplied from the truck 82, an enclosed chute 138 for coupling the chamber 136 with the upper portion of the hopper 80, and an auger 140 disposed in chute 138 for transporting wet concrete from the chamber 136 through chute 138 to the hopper 80. The auger 140 is driven by a motor 52. The hopper 80 defines a pathway along which wet concrete is delivered to the space 90 enclosed by the elongated form 32 and the walls of the mule 60 in the first and second embodiments, and the first and second elongated forms 32*a* and 32*b* in the third embodiment.

The slip former 30 of the present invention additionally differs from conventional slip formers in that it comprises a side arm assembly 150 (FIGS. 2A and 2B) for supporting and slidingly engaging the elongated form 32 in the first and second embodiments and the first and second elongated forms 32*a* and 32*b* in the third embodiment. As is discussed in detail below, the side arm 150 assembly is made from a plurality of elongated, rigid members, which are typically made from steel or other material having a high strength, that can be readily fabricated.

The side arm assembly 150 of the first and second embodiments of the invention (FIGS. 2A, 3A and 3B) includes a pair of horizontally extending support rails 152*a* and 152*b*, each comprising a bearing surface 154 for slidably engaging and bearing against the outer surface of the elongated form 32, as discussed in greater detail hereafter. The support rails 152*a* and 152*b* typically have a U-shaped channel configuration. The support rails 152*a* and 152*b* lie parallel to one another and are spaced a predetermined distance (e.g., about 2 feet) apart. Typically, only two support rails 152*a* and 152*b* are required. However, three or more rails can be used, in which case the spacing between adjacent rails will, of course, be less than when two rails are used. The support rails 152 are preferably somewhat longer than mule 60, with the leading edge 156 (FIG. 2A) of the support rails 152*a* and 152*b* being positioned in approximately coplanar relation with the leading edge 84 of the mule 60.

The side arm assembly 150 to the first and second embodiments also includes a plurality of vertical supports 162, which are attached by welding (FIG. 3 A) or other conventional ways, such as an adjustable attachment mechanism (FIGS. 2B and 3B–3D) described in greater detail below to the side rails 152*a* and 152*b* in orthogonal relation therewith. The vertical supports 162 are spaced approximately evenly along the length of the support rails 152*a* and 152*b*. In the embodiment of support arm assembly 150 illustrated in FIGS. 2A and 3A, three vertical supports 162 are employed. Alternatively, two (FIGS. 2B and 3B–3D) or four or more vertical supports 162 may be used.

The side arm assembly 150 of the first and second embodiments further includes a plurality of elongated hollow sleeves 164 which are open at both ends. The sleeves 164 are attached to the hopper 80 or the support structure 67, as the case may be, several feet above the upper wall 64 of the mule 60 so as to extend roughly parallel to the surface 66 on which the concrete structure 20 is formed. Preferably, the sleeves 164 have a length of at least 2 feet, and the outermost end 163 (i.e., the left end as seen in FIGS. 3A and 3B) of the sleeve is positioned above the outermost end (i.e., the left end as seen in FIGS. 3A and 3B) of the upper wall 64 of the mule 60. One sleeve 164 is provided for each vertical support 162.

The side arm assembly 150 of the first and second embodiments also includes a plurality of elongate, horizontally extending members 166, one for each hollow sleeve 164. Each member 166 is slidably mounted in a corresponding respective sleeve 164, and is sized to make a close sliding fit in the sleeve 164. In the first embodiment of the invention, the length of each member 166 is selected so that when one end of the member is received in a sleeve 164 such that the innermost end (i.e., the fight end as seen in FIG. 3A) of the member is flush with the innermost end (i.e., the fight end as seen in FIG. 3A) of the sleeve 164, the outermost end of member 166 projects about 2 feet beyond the outermost end of sleeve 164. In the second embodiment, the outermost end terminates sooner. See FIG. 3B. One or more set screws 168 or other locking means are provided for locking members 166 to sleeves 164 in selected axial relationship therewith.

The side arm assembly 150 of the first and second embodiments of the invention further include a plurality of sleeves 176, one for each support 162. Each sleeve 176 is sized to surround and slidably engage a corresponding respective support 162. Each sleeve 176 includes at least one set screw 178 or other lock means for locking the sleeve to the support 162 with which it is associated in selected axial relation therewith. Each sleeve 176 is pivotally mounted at a predetermined location to an associated member 166 via a pin 179. In the case of the first embodiment of the invention (FIG. 3A), the predetermined location is spaced inwardly from the outermost end of the member 166 a distance equal to approximately one-third of the overall length of the member 166. In the case of the second embodiment (FIG. 3B), the predetermined location is at the end of the member 166.

Finally, as shown in FIGS. 3A and 3B, the support arm assembly 150 of the first and second embodiments of the invention include a plurality of angle adjustment mechanisms 180 (not shown in FIG. 2A), each for adjusting the relative angular relationship between a vertical support 162 and the horizontal member 166 associated with the vertical support 162. In the first embodiment of the invention (FIG. 3A), one end of each adjustment mechanism 180 is attached to the horizontal member 166 adjacent the outermost end of the member 166, and the other end of the adjustment mechanism 180 is slidably attached (e.g., with a conventional slider track assembly) to the vertical support 162 associated with the horizontal member 166 so that the adjustment mechanism 180 may be positioned to extend downwardly from the member 166 to the support 162 at roughly a 45° angle relative to the longitudinal axis of the member 166 and the support 162. Preferably, each adjustment mechanism 180 comprises a conventional mechanical turnbuckle, although other devices for adjusting the relative angular relationship of the member 166 relative to the support 162 may also be employed.

In the second embodiment of the invention (FIG. 3B), the adjustment mechanisms extend from a bracket 183 attached to the top of each support 162 to a bracket 185 attached to the top of the associated member 166, inward of the support, i.e., toward the hopper 80. Again, preferably, the adjustment mechanisms comprise turnbuckles, although other devices can be used.

The slip former 30 additionally comprises a conventional valve and manifold system 188 for providing pressurized hydraulic fluid over five or more lines 189 (only three of which are shown in FIG. 2A) to a plurality of conventional external hydraulic vibrators 190*a*, 190*b* . . . of the type widely used in the construction of poured concrete structures to eliminate voids in the wet concrete as it is being poured. A suitable external vibrator which may be employed as vibrators 190*a*, 190*b* . . . is manufactured by Minnich Manufacturing Co., Inc., of Mansfield, Ohio, and is identified by Model No. M-450. To obtain optimal results, it is preferred that one extemal vibrator 190*a* be attached to upper rail 152*a* of side arm assembly 150 and another vibrator 190*b* be similarly attached to lower rail 152*b* directly below the hopper 80, such that the vibrators face the opening 94 in the mule 60.

In addition, it is preferred that three or more conventional, internal hydraulic vibrators 192*a*, 192*b*, . . . only two of which are shown in FIG. 2A, be positioned in the lower portion of hopper 80, and the portion of the space 90 enclosed by the elongated form 32 and the walls 62 and 64 of the mule 60 located directly beneath hopper 80. Two such vibrators are identified in FIG. 2A as 192*a* and 192*b*. A suitable internal vibrator 192*a*, 192*b*, . . . is the Model No. 41-9750 manufactured by Wyco Tool Co. of Racine, Wis.

Turning now to FIGS. 1, 3A, 3B and 5A, the elongated form 32 of the first and second embodiments of the present invention includes a continuous elongated wall 200. The latter is preferably made from a plurality of discrete sheets of plywood measuring 4 feet wide by 8 feet long, and having a thickness of about 1.125 inches. The plywood sheets are attached end-to-end using conventional fasteners so as to form an elongated, substantially smooth inner surface 202. Although wall 200 is preferably made from plywood sheets due to their strength, rigidity, and relatively low cost, other materials, such as reinforced rigid plastic panels, may also be employed.

The height and length of wall 200 will vary as a function of the height and length of the concrete structure 20 being formed, although the wall is preferably at least about 6 inches taller than the height of the concrete structure 20 being formed. Wall 200 must ultimately be as long as the concrete structure 20 being formed. However, under certain circumstances (e.g., when structure 20 is so long that it cannot be formed in a single shift, i.e., longer than about 1,000 feet) portions of wall 200 used in forming the beginning portion of the structure may be disassembled after such beginning portion is formed, as discussed hereinafter, and attached to portions of the wall adjacent which structure 20 has not yet been formed. Such "leap frogging" in the construction of wall 200 will typically reduce the material costs associated with forming a concrete structure 20 so long as the wall is reassembled at a rate such that the length of the wall 200 increases at a speed in excess of the speed at which slip former 30 travels during the construction of the structure 20, as discussed below.

Figure 5A:
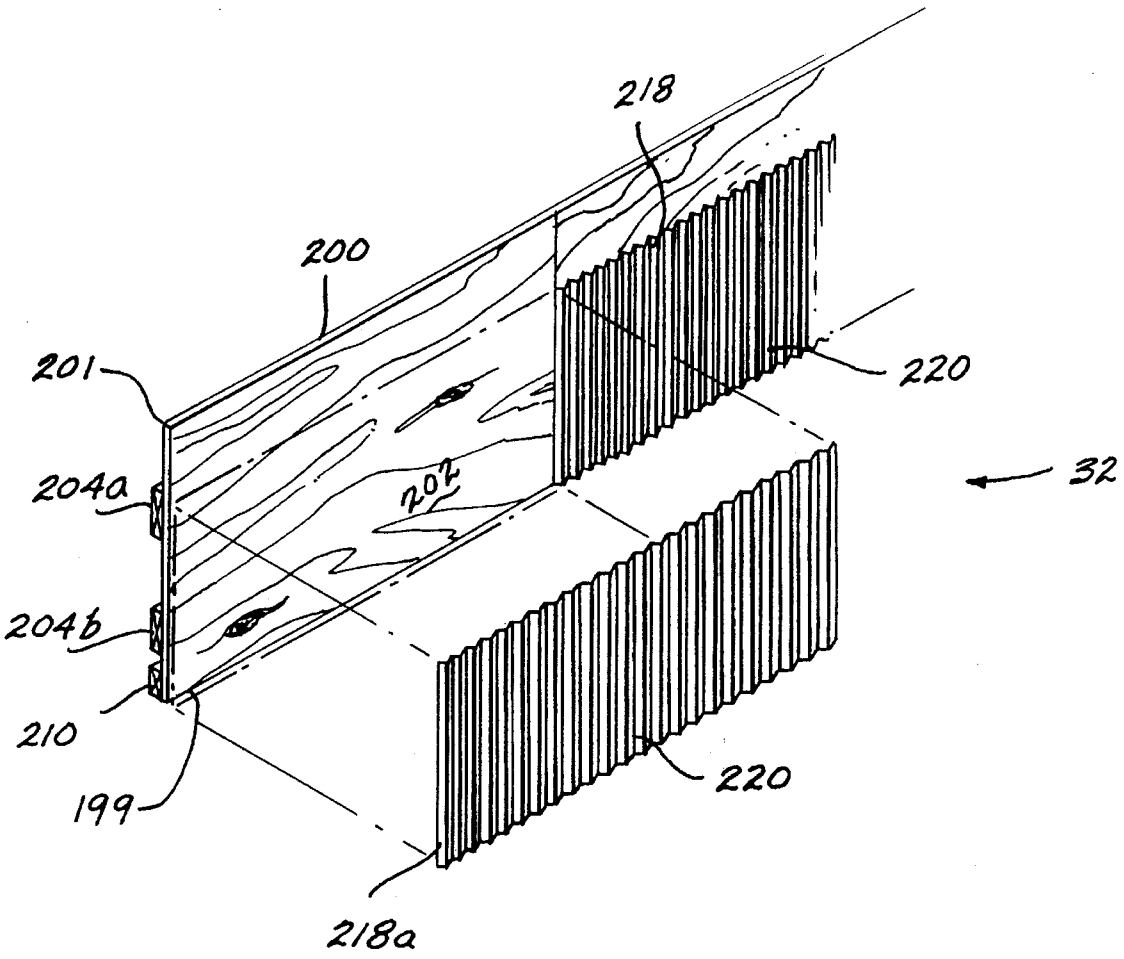
FIG. 5A is an exploded, perspective view of an elongated form created by a system formed in accordance with the first or second embodiments of the present invention.

The elongated form 32 of the first embodiment of the invention further includes a plurality of continuous slider tracks 204, one for each of the rails 152 of the sidearm assembly 150. The slider tracks 204 are attached to the outer surface 206 (FIGS. 3A and 5A) of the wall 200 so as to extend parallel to one another and parallel to the bottom edge 199 of the wall 200. The slider tracks 204 are spaced apart from one another a distance corresponding to the space between the rails 152. In addition, the slider tracks 204 are vertically positioned on the outer surface 206 so that after the elongated form 32 is erected, the upper track 204 is positioned adjacent an upper edge of the concrete structure 20 being formed and the lower track 204 is positioned adjacent an intermediate portion of the structure, as illustrated in FIGS. 3A and 5A. Of course, when selecting the vertical placement of the slider tracks 204 on the outer surface 206, the spacing between the tracks must always correspond to the spacing between the rails 152. The slider tracks 204 are preferably made from dimensional lumber having a nominal cross-sectional dimension of 2 inches wide by 6 inches high. The pieces of the dimensional lumber are butted end-to-end when attached to the outer surface 206 so as to form a continuous track, with the points of attachment of the pieces being other than at the junction of adjacent pieces of plywood or other material used to fabricate the wall 200. As illustrated in FIG. 3A, the slider tracks 204 include outer surfaces 208 for slidably engaging rails 152, as discussed in greater detail hereafter.

Optionally, the wall 200 may include a continuous base support 210 attached to the bottom end of the outer surface 206. The base support 210 cooperates with the slider tracks 204 in tying together the discreet panels (e.g., plywood sheets) used to make the wall 200.

The slider tracks are not included in the second and third embodiments of the invention as shown in FIGS. 2B, 3B, 3D, and 5B. Rather, the rails 152 ride on the outer surface 206 of the walls 200. The walls are joined by the base support 210 attached to the outer surface 206 of the walls 200 and by inverted, short, U-shaped channels 207 located at the top of the walls where the panels that form the walls are joined. See FIG. 5B. The U-shaped channels are formed of a suitably strong material, i.e., steel, and are of adequate length (2 ft.). Suitable U-shaped channels are Unistruts, commonly used in the construction industry.

The wall 200 preferably, although not necessarily, includes a liner 218 attached to inner surface 202 of the wall 200 for defining the texture of the outer surface 26 of the concrete structure 20. As illustrated in FIG. 5A, the liner 218 may comprise a plurality of discreet panels, one of which is identified as 218*a*, attached end-to-end so as to form a continuous liner. The panels used to form the liner 218 are of the type widely used in forming concrete structures on a non-continuous, piece-by-piece basis. Such panels are sold, for instance, by L. M. Scofield Co. of Los Angeles, Calif., and are identified by the federally registered trademark LITHOTEX®.

The surface configuration of the outer surface 220 of the liner 218 will vary as a function of the desired texture to be provided on the outer surface 26 of the concrete structure 20. However, in all cases, the surface configuration of the outer surface 220 will consist of the reverse image of the surface pattern contained on outer surface 220. In the embodiment of liner 218 illustrated in FIG. 5A, the outer surface 220 comprises a plurality of vertically extending ridges and a plurality of vertically extending grooves, with each ridge being positioned adjacent a groove so as to create a pattern of alternatively interspersed grooves and ridges. Alternatively, the pattern on surface 220 of liner 218 may comprise discontinuous, substantially vertically extending concave or convex portions, transversely extending, continuous or discontinuous, elongate concave or convex portions, continuous or discontinuous curved, concave or convex portions and discontinuous horizontally extending concave or convex portions. In addition, surface 220 may have a smooth configuration or may comprise continuous, elongate, horizontally extending convex or concave portions, although the formation of a concrete structure 20 using the liner 218 having such a pattern does not take full advantage of the novel attributes of the present invention.

FIGS. 2B and 3D show the third embodiment of the present invention. As with the first and second embodiments, the slip former 30 is a modified version of a conventional slip former of the type used to slip form unitary, horizontally extending concrete structures, such as traffic barriers. The slip former 30 of the third embodiment differs from a conventional slip former, and from the first and second embodiments, in that it includes a side am 150 having two support means for supporting elongated forms 32*a* and 32*b*, which define the side boundaries of the concrete structure 20.

The slip former 30 of the third embodiment is substantially similar to the slip former of the first and second embodiments. In order not to unduly lengthen the description of the third embodiment of the invention, the similarities with the first and second embodiments are not described-only the major differences are described. Briefly, the slip former 30 includes a frame 50, a motor 52 supported on a frame 50, and two pairs of endless tracks 54*a* and 54*b*, which are also attached to the frame 50. As discussed in greater detail above, the front and rear pairs of endless tracks 54*a* and 54*b* move simultaneously to the right and to the left independently to the other pair of tracks to allow the slip former to accurately trace the elongated path 22.

The slip former 30 of the third embodiment of the present invention includes a side arm assembly 150 (FIG. 2B) for supporting and slidably engaging both of the elongated forms 32*a* and 32*b*. The side arm assembly 150 is made from a plurality of elongated, rigid members, which are typically made from steel or other materials having a high strength, and which can be readily fabricated. The side arm assembly 150 includes at least two pairs of horizontally extending rails 152 each comprising a bearing surface 154 for slidably engaging and bearing against the outer surfaces of the elongated forms 32*a* and 32*b*. The support rails 152 are similar to the support rails 152 in the first and second embodiments described in greater detail above. It will be readily apparent to those skilled in the art that variations in the number and shape of the rails 152 can be made to accommodate the specific concrete structure being formed.

As with the first and second embodiments, the side arm assembly 150 includes a plurality of vertically extending supports 162, which are attached by welding or, preferably, by an adjustable attachment mechanism of the type described below, to the side rails 152*a* and 152*b* in orthogonal relationship therewith. The supports 162 are spaced approximately evenly along the length of the rails 152. In the embodiment shown in FIG. 2B, there are two supports 162 on either side of the concrete structure 20. In comparison to the first embodiment shown in FIGS. 2A and 3A, which includes three supports 162, like the second embodiment shown in FIG. 3B and 3C, the third embodiment includes two supports 162. The two supports shown in FIG. 2B are generally larger and stronger than the three supports shown in FIGS. 2A and 3A. They are generally similar to the supports 162 shown in FIG. 3B. As will also be readily apparent to those skilled in the art, any number of supports 162 can be used depending on the particular concrete structure 20 being formed. In addition, with respect to the third embodiment, it is not necessary to have the same number of supports 162 supporting both of the elongated forms 32*a* and 32*b*. Different numbers of supports for each elongated form can be used. Thus, variation in the number of supports 162 should be considered user dependent.

The side arm assembly 150 of the third embodiment further includes a plurality of elongated hollow sleeves 164 that are open at both ends. As shown in FIG. 2B, the sleeves 164 are attached to the frame 50 of the slip former 30, preferably several feet above the uppermost portion of the elongated forms 32*a* and 32*b*. Preferably, the sleeves 164 have a length sufficient to secure and firmly hold in place the side arm assembly 150. In this regard, one sleeve 164 is provided for each support 162.

The side arm assembly 150 also includes a plurality of elongate, horizontally extending members 166, one for each hollow sleeve 164. Each member 166 is slidably mounted in a corresponding respective sleeve 164 and is sized to make a close sliding fit in the sleeve 164. The length of each member 166 is additionally selected so that when one end of the member is received in a sleeve 164, such that the innermost end (i.e., the fight end as seen in FIG. 2B) of the member is flush with the innermost end (i.e., the fight end as seen in FIG. 2B) of sleeve 164, the outermost end of member 166 will project several feet beyond the outermost end of sleeve 164. One or more set screws 168 or other locking means are provided for locking member 166 to sleeve 164 in select axially relationship therewith.

The side arm assembly 150 further includes a plurality of sleeves 177, one affixed to each support 162, near the upper end thereof. Each sleeve 177 is sized to surround and slidably engage one of the members 166. Each sleeve 177 includes at least one set screw 181 or other lock means for locking the sleeve to the member 166 which it surrounds. In the arrangement shown in FIG. 2B, preferably the vertically extending supports 162, the sleeves 177, and the elongated horizontally extending members 166 are sufficiently rigid to support both of the elongated forms 32a and 32*b* such that additional bracing is not required. This differs from the first and second embodiments wherein an angle adjustment mechanism 180 is used to brace and adjust the supports 162. However, as will be readily apparent to those skilled in the art, depending on the size, shape and strength of the materials chosen to construct assembly 150, in some actual embodiments of the invention it may be necessary to include additional bracing to securely hold the supports 162 in place.

The supports 162 in both the second and third embodiments of the invention (FIGS. 2B and 3B–3D) include a plurality of sleeves 175 for adjusting the relative position of the horizontally extending rails 152. The sleeves 175 include set screws 181 for locking the sleeves at desired vertical positions along the supports 162. In addition, each sleeve 175 supports an adjustment bolt 182. The adjustment bolts 182 are long bolts having threads screwed through a housing attached to one side of the sleeves such that the adjustment bolts project toward the side rails 152*a* and 152*b*. The inner ends of the bolts 182 are attached to the rails by a clevis mechanism 184. As a result, rotation of the adjustment bolts 182 moves the rails 152*a* and 152*b* independently in a direction lateral to the axis of concrete structure 20 to accommodate non-vertical walls, as well as to properly adjust the rails 152*a* and 152*b* with respect to the elongated forms 32*a* and 32*b*.

As in the first and second embodiments, the third embodiment, as shown in FIGS. 2B and 3D, includes vibrators 190*a* and 190*b* attached to the rails 152*a* and 152*b*. Preferably, the vibrators 190*a* and 190*b* are attached to the rails 152*a* and 152*b* located on both sides of the elongated forms 32*a* and 32*b*. In addition, as discussed above with respect to the first and second embodiments, a vibrator (not shown) is attached to the lower portion of the hopper 80.

Figure 5B:
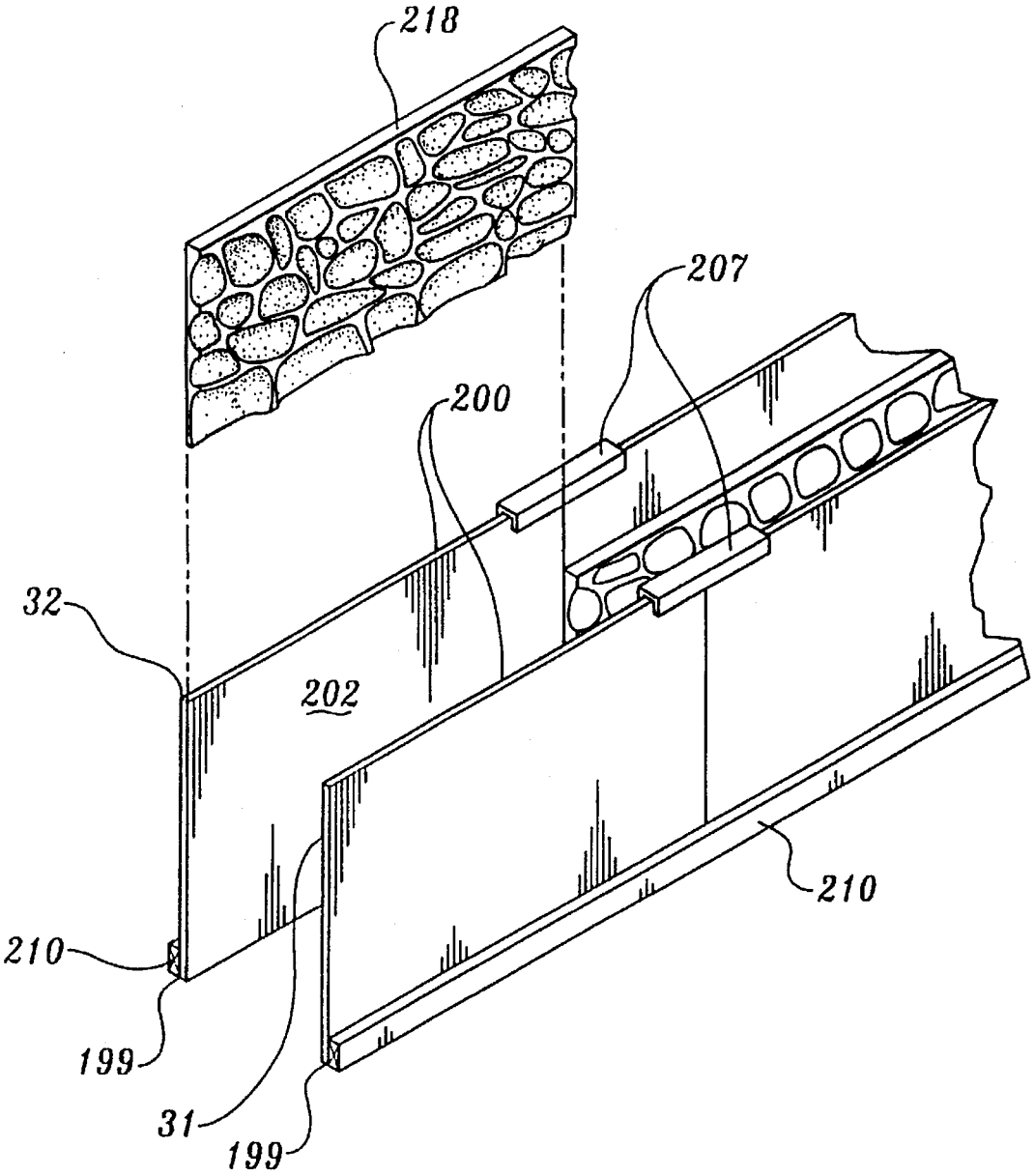
FIG. 5B is an exploded, perspective view of a pair of elongated forms created by a system formed in accordance with the third embodiment of the present invention.

Referring now to FIG. 5B, both elongated forms 32*a* and 32*b* of the third embodiment of the invention include two continuous elongated walls 200. As with the first and second embodiments, the walls 200 are preferably made from a plurality of discrete sheets of plywood. Also, as with the first and second embodiments of the invention, the plywood sheets are attached end-to-end using conventional fasteners so as to form an elongated, substantially smooth inner surface 202. The height and length of the walls 200 will vary as a function of the height and length of the concrete structure being formed.

The elongated forms 32*a* and 32*b* further include a plurality of continuous slider tracks 204, one for each of the pairs of rails 152 on side arm assembly 150. The slider tracks 204 attach to the outer surface 206 (FIG. 3D) of each of the walls 200 so as to extend parallel to one another and parallel to the bottom edge 199 of the walls 200. The slider tracks 204 are spaced apart from one another a distance corresponding to the space between the pairs of rails 152. The slider tracks 204 are similar to the slider tracks described above in connection to the first and second embodiment, except that the third embodiment includes twice as many slider tracks because two elongated forms 32*a* and 32*b* are included.

The walls 200 preferably, although not necessarily, include liners 218 attached to the inner surface 202 of the walls 200 that define the texture of both side surfaces of the concrete structure 20. While it is not necessary that the liners 218 be identical, they can be identical. The advantage of the third embodiment of the present invention is that textured surfaces can be placed on both sides of the concrete structure 20. Preferably, at least one of the textures is other than parallel to the elongated path 22.

As with the first and second embodiments shown in FIGS. 2A, 3A, 3B and 3C, the third embodiment shown in FIGS. 2B and 3D also includes a transport assembly 134 having an auger 140 for delivering wet concrete to the hopper 80. In operation, a concrete truck 82 delivers wet concrete to the transport assembly 134. The wet concrete is transferred up the enclosed chute 138 and dropped into the hopper 80. The hopper 80, rather than being attached to a mule 60 as in the first and second embodiments, is attached to a substantially horizontal plate assembly 211. The plate assembly 211 has the shape of an open topped box. The bottom of the plate assembly 211 provides an upper wall or surface for the concrete structure 20. As shown in FIG. 2B, the trailing end of the plate 211 is fastened to the slide arm assembly 150, specifically one of the horizontally extending members 166, by an adjustment mechanism 212. The adjustment mechanism 212 comprises a pair of sleeves 213 mounted in the horizontally extending member 166 and vertically oriented turnbuckles 214. The lower ends of the vertically oriented turnbuckles are attached to the trailing wall of the box shaped plate assembly 211 by a clevis 215.

Figure 6:
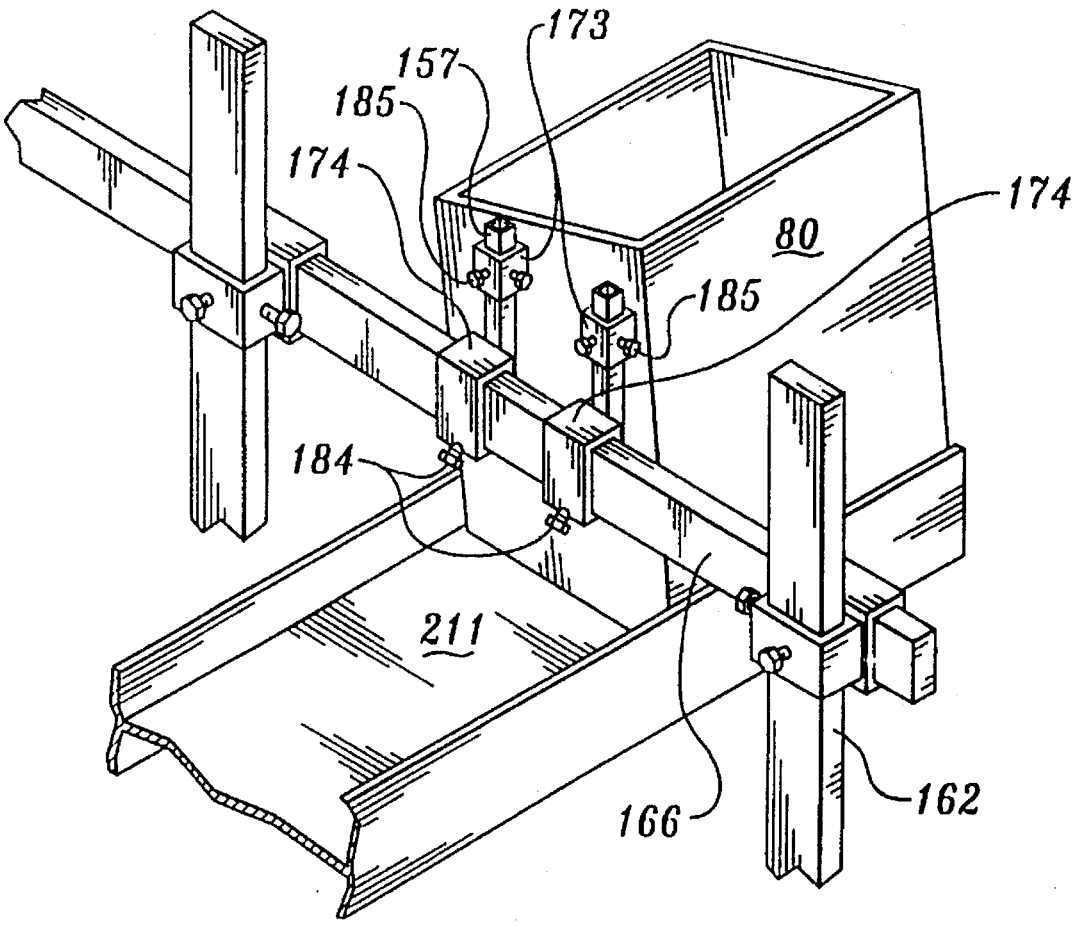
FIG. 6 is a perspective view of the rear portion of the hopper of the third embodiment of the present invention illustrating the adjustment means used to raise and lower the hopper, and move the hopper laterally.

The front portion of the plate assembly 211, which includes the hopper 80, is attached to the other horizontally extending member 166 by the adjustment mechanism shown in FIG. 6. FIG. 6 illustrates a pair of elongated, vertically extending members 157 securely attached to sleeves 174 and mounted on the horizontally extending member 166. The sleeves are locked in position by tightening set screw 184. Attached to the hopper 80 are sleeves 173 having set screws 185. The sleeves are mounted on the vertically extending members 157. When set screws 185 are loosened, the hopper 80 can be moved vertically with respect to the horizontally extending member 166.

The adjustment shown in FIG. 6 and described above allows the hopper 80 to be positioned laterally and vertically to accommodate the fabrication of the concrete structure 20. As it will be readily apparent to those skilled in the art, the plate 211 and the hopper 80 can be attached to the horizontal members 166 in other ways, including attaching the plate 211 to the member 166 independently of the hopper 80. The important feature is allowing the hopper 80 and the plate member 211 to be adjusted with respect to member 166.

Referring to FIGS. 3B and 3C, there is shown an adjustable method of attaching the horizontally extending rails 152*a* and 152*b* to the vertically extending supports 162 that is used in the second embodiment of the invention. More specifically, the vertically extending supports 162 extend substantially above the sleeve 176 that is affixed to the ends of the horizontally extending members 166. As noted above, located at the upper ends of the supports 162 are attachment brackets 183 attached to one end of the adjustment mechanisms 180. The second end of the adjustment mechanism 180 is attached to the top of the elongated horizontally extending member 166. As a result, it is not necessary to extend the horizontal member 166 beyond the vertical member 162 as shown in FIG. 3 A. As a result, a slip former 30, including a side arm assembly 150 of the type shown in FIG. 3B, requires less clearance space than does a side arm assembly of the type shown in FIG. 3A. This may be particularly important when the concrete structure 20 is being placed near a vertical structure such as another wall, trees or shrubbery.

Also shown in FIGS. 3B and 3C are a pair of tie rods 158 that secure the upper rail 152*a* to the lower rail 152*b*. The tie rods 158 pass through fasteners 159 that are affixed to the upper and lower rails. The tie rods 158 assist in securely holding the rails 152 at a predetermined distance from one another allowing the rails to properly track.

In connection with the following description of the operation of the textured slip forming system of the first, second, and third embodiments of the present invention, reference should be made to FIGS. 1 through 6. While the following description describes the manner in which the first and second embodiments of the present system are used to form a traffic barrier positioned on the top surface 300 of the outermost portion of a bridge 302, it will be readily apparent to those skilled in the art from this description how the third embodiment can be used to create a concrete structure. This illustration is meant to be exemplary of the present invention and not limiting with respect to the apparatus and method.

As the first step in the formation of a concrete structure 20 having at least one textured surface, a conventional rebar structure 304 is preferably, although not necessarily, set up along path 22. The height and configuration of rebar structure 304 will vary as a function of the size and configuration of the concrete structure 20 being formed.

Next, or in some cases before rebar structure 304 is erected, an elongated form 32 is set up so as to extend along a typically vertically extending plane which extends along path 22 and is positioned adjacent the location where it is desired that the outer (textured) surface 26 of the structure 20 be positioned. Preferably, the length of the elongated form 32 is about equal to the length of the concrete structure 20 to be formed in a single day. Portions of the form 32 already used in the formation of the concrete structure 20 can be disassembled and reassembled further along the direction of travel of slip former 30 provided the advancing length of form 32 increases at least as fast as the speed of travel of the slip former 30. In this case, the length of the form 32 may be somewhat less than the length of structure 20 to be formed in a single day. With respect to the third embodiment of the present invention, two opposing forms 32*a* and 32*b* are set along the path 22, each form defining one of the textured side surfaces 26 and 27 of the structure 20.

The form 32 or forms 32*a* and 32*b* are typically erected by first positioning a discrete panel making up the wall 200 (or walls 200) adjacent the location where the outer surface(s) 26 (27) of the structure 20 is (are) to be positioned, and then attaching the discrete pieces of lumber making up the slider tracks 204 to the outer surface 206 of the wall(s) 200 so as to bridge the junction of adjacent panels. In this assembly, it is important that the discrete panels making up wall(s) 200 be positioned in abutting relation so as to form a continuous wall. In some instance, it may be desirable to attach fasteners in addition to those shown at the junction of adjacent panels making up wall 200. The base supports 210 are attached to bottom portion 199 of outer surface 206 of wall(s) 200 so as to tie together the discrete panels making up wall(s) 200. Although it is typically desirable that the textured surface 26 and/or 27 of the structure 20 extend perpendicular to the surface of path 22, under certain circumstances it may be desirable to incline the textured surface(s) inwardly or outwardly. If such inclination of textured surface 26 and/or 27 is desired, then the form 32 is erected so as to lean inwardly or outwardly an amount corresponding to the desired degree of inclination of surface 26 and/or 27. In some cases, it may be desirable to use angled struts or other means for temporarily supporting form 32 prior to the arrival of the slip former 30. Finally, the discrete panels making up the liner 218 are attached to inner surface 202 of the wall(s) 200 so as to form a continuous liner. Alternatively, the liner may be attached to the panels prior to erection.

Next, a plurality of string line supports 99 are positioned adjacent path 22, and a string line 100 is attached to the supports 99. As is well known in the art, the supports 99 are positioned so that string line 100 extends parallel to and is positioned in predetermined relation above and to one side of path 22.

Then, the slip former 30 is positioned adjacent the form 32 at the leading end of the path 22 so that, in the first and second embodiments, the mule 60 will contact the form 32 in the manner required to form concrete structure 20, as discussed hereinafter. The positioning is achieved by providing appropriate instructions to the control panel 106 of control system 98. These instructions cause the controller 105 to operate the hydraulic motors 76*a*, 76*b*, 76*c*, and 76*d*, and 79*a* and 79*b*, so as to cause the slip former 30 to move so that the upper wall 64 of the mule is positioned parallel to the surface of path 22 and is positioned a distance above the surface equal to the height at which the top surface 25 of the concrete structure 20 is to be positioned above the surface of path 22, as illustrated in FIGS. 3A and 3B. The position of the slip former 30 is additionally adjusted so that the outermost portion (i.e., the right portion as seen in FIGS. 3A and 3B) of the upper wall 25 engages the surface 220 of the liner 218, as illustrated in FIG. 3A and 3B.

Next, the support mechanisms 110 are adjusted so that the wands 102 and 104 of the alignment sensors 101*a* and 101*b* and the grade sensors 103*a* and 103*b*, respectively, engage the string line 100. More specifically, such positioning of the alignment sensors 101*a* and 101*b* and the grade sensors 103*a* and 103*b* is accomplished by the combined adjustment of the horizontally extending telescopic member 112, via the adjustment device 116, and the vertically extending telescopic member 120, via the adjustment device 124. Once the proper placement of the alignment sensors 101*a* and 101*b* and the grade sensors 103*a* and 103*b* is achieved, telescopic member 112 is locked in place using set screw 113, and telescopic member 120 is locked in place using set screw 122.

In the first embodiment, the side arm assembly 150 is positioned so that the rails 152 thereof extend parallel to the slider tracks 204, and so that the beating surfaces 154 of the rails 152 slidingly engage the outer surfaces 208 of the slider tracks 204 or the outer surface 206 of the wall 200. In the second embodiment the rails engage the outer surface 206 of the wall 200. In the third embodiment, the mule 60 is replaced with the second support structure of the side arm assembly 150. The side arm assembly is adjusted such that the first support structure engages the outer surface 206 of the wall 200 of one of the elongated forms 32*a* and the second support structure engages the outer surface 206 of the wall 200 of the other elongated form 32*b*. Adjustment of the side arm assembly is achieved by appropriate linear positioning of the horizontal members 166 in sleeves 164 and the vertically oriented supports 162 in the sleeves 176 and by the appropriate angular adjustment of vertical supports 162 relative to horizontal members 166 using the angle adjustment mechanisms 180, or in other manners described above that depend on which embodiment of the invention is being adjusted. Upon completion of the adjustments of the side arm assembly 150, the formation of concrete structure 20 begins.

To begin formation, a concrete supply truck 82 delivers wet concrete having a preferred slump ranging from about 1 inch to 2 inches to the open top container 136 of the transport assembly 134. As used herein, "slump" refers to the amount a conically shaped mass of wet concrete originally supported in a cone 12 inches high will decrease in height (i.e., slump) when the cone supporting the mass of concrete is removed. The concrete delivered by the truck 82 is transported by the auger 140 up the chute 138, where it is dispensed into the interior of hopper 80. The concrete falls down through the opening 94 into the space 90 defined by the elongated form 32 and the walls 62 and 64 of the mule 60 in the first and second embodiments, and by the elongated forms 32*a* and 32*b* in the third embodiment. As the concrete travels downwardly into the space 90, any voids in the concrete are eliminated by the vibrators 190*a*, 190*b*, . . . , and 192*a*, 192*b*, . . . Due to the low slump of the concrete and the action of the vibrators, the concrete entirely fills the space 90 below hopper 80, including all concave portions of the liner 218 of the elongated forms. Next, the slip former 30 moves along the path 22 in the direction along which concrete structure 20 is to be formed at the rate of about 1 to 2 feet per minute. The surface configuration of the textured surface 26 and/or 27 is formed substantially as soon as the entire space 90 defined by the mule 60 and the form 32 on the first and second embodiments or the forms 32*a* and 32*b* in the third embodiment is filled with concrete as a consequence of the engagement of the concrete with liner 218 of the elongated form. As the slip former moves along the elongated form, the beating surfaces 154 of the rails 152 slidingly engage the outer surface 208 of slider tracks 204 or the outer surface of the walls 200, depending on the embodiment of the invention.

As a consequence of the sliding engagement, the side arm assembly 150 opposes outward movement of forms 32 or 32*a* and 32*b* caused by the weight of the concrete delivered to the space 90. The opposing force provided by side ann assembly 150 is only required for a relatively short period of time due to the relatively low slump of the concrete used to form the structure 20, and the support provided by the rebar structure 304, if included. By the time the slip former 30 has passed by just-formed portions of concrete structure 20, the concrete structure has sufficient structural integrity that the support provided by the side arm assembly 150 is no longer required. If struts or other supports (not shown) are used for temporarily supporting the elongated forms, the latter are removed just before slip former 30 arrives at the location where such struts were employed. Typically, elongated form 32 is allowed to remain standing for about 2 to 4 hours after the concrete structure 20 has been formed, although the form may be allowed to stand for as long as desired (e.g., several days after the structure has been formed). So long as concrete supply trucks 82 arrive periodically so as to ensure a continuous supply of concrete is provided to the slip former 30, and elongated form(s) of adequate length are erected, the length of a concrete structure 20, which may be formed with the present system, is limited only by labor and machine reliability factors.

As discussed above, the present system is particularly well adapted for use in the formation of horizontally extending concrete structures, such as traffic barriers. However, the basic concept of the present system may also be employed in the formation of vertically extending concrete structures having a surface with a textured pattern comprising concave and convex portions which extend other than just in the vertical direction. To form vertically extending structures, the elongated form(s) are erected so as to extend vertically along a plane adjacent to which the textured surface of the vertically extending structure is to be positioned. Inasmuch as the slip former 30 is adapted to travel along a road bed or other non-vertical surface, alternative structures for causing the slip former 30 to move vertically so as to form the slip formed surface of the vertically extending structure must be employed. Such structures may, for instance, be similar to the yoke and leg assembly disclosed in U.S. Pat. No. 4,314,798. Of course, the specific size and configuration of the slip former 30 must be modified to correspond to the desired size and configuration of the slip formed surface of the vertically extending structure being formed.

Although support mechanisms 110 and side arm assembly 150 are manually adjusted, as discussed above, power adjustment systems for controlling the position of side arm assembly 150 are within the ambit of the present invention. For instance, pneumatic or hydraulic systems of the type well known to those of ordinary skill in the art may be used for adjusting the position of the side arm assembly 150, including the mule 60 used in the first and second embodiments.

While the preferred embodiments of the invention have been illustrated and described, it will be appreciated that within the scope of the appended claims, various changes can be made therein without departing from the spirit and scope of the invention.

The embodiments of the invention in which an exclusive property or privilege is claimed are defined as follows:

1. A system for continuously forming a concrete structure which extends in a substantially horizontal direction and has a predetermined cross-sectional configuration, the system comprising:

a frame;

first form means, coupled to said frame, for supporting a portion of one side of a concrete structure being formed;

second form means for supporting at least a portion of an opposite side of the concrete structure and for forming a pattern in the outside surface of the opposite side comprising concave or convex portions which extend other than just in the substantially horizontal direction, said concave or convex portions forming the reverse image of a pattern to be provided on the opposite side of the concrete structure, said second form means coacting with said first form means so as to enclose an area having a cross-sectional configuration corresponding to the predetermined cross-sectional configuration of the concrete structure, said second form means including a rigid wall to structurally support said pattern, wherein said second form means is fixed with respect to a surface on which the concrete structure is formed;

drive means coupled to said frame for causing said frame to move in said substantially horizontal direction; and support means coupled to said frame so that said drive means causes said support means to move in said substantially horizontal direction for supporting successive portions of said second form means relative to said first form means as said drive means moves in the horizontal direction so as to permit said second form means to coact with said first form means so as to enclose said area, said support means not contacting the concrete structure and only contacting a portion of said rigid wall to reduce friction therebetween.

2. A system according to claim 1, wherein said first form means is attached to said frame to move therewith in the substantially horizontal direction, and wherein said first form means includes a first wall having a configuration, as viewed in cross section, corresponding to the cross-sectional configuration of one side of the structure.

3. A system according to claim 2, wherein said first wall includes an upper end, and said first form means further includes a second wall attached to said upper end of said first wall, said second wall defining the configuration and surface pattern of an upper surface of the structure.

4. A system according to claim 1, wherein said second form means includes an elongate planar form installable so as to extend in said substantially horizontal direction, said form having an inner surface and an outer surface.

5. Claim 5 is a system according to claim 4, wherein said inner surface includes said convex or concave portions.

6. A system according to claim 5, wherein said convex or concave portions comprise a plurality of elongate portions, the elongate axis of said portions extend perpendicular to said substantially horizontal direction.

7. A system according to claim 5, wherein said convex or concave portions comprise a plurality of curved portions.

8. A system according to claim 5, wherein said convex or concave portions comprise a plurality of elongate portions, the elongate axis of said portions extend transversely to said substantially horizontal direction.

9. A system according to claim 1, wherein said second form means includes bearing plate means for providing at least one continuous surface extending in said substantially horizontal direction.

10. A system according to claim 9, wherein said bearing plate means comprises two continuous, elongate members which extend in parallel in said substantially horizontal direction, said members being spaced a predetermined distance from one another, said elongate members being positioned to contact said support means.

11. A system according to claim 1, said second form means including substantially horizontally extending bearing plate means, further wherein said support means comprise a slide means for slidingly engaging said bearing plate means as said support means is caused to move in said substantially horizontal direction by said drive means.

12. A system according to claim 11, wherein said slide means comprises:

a slide assembly for slideably engaging said bearing plate means;

a support assembly coupled to said frame and said slide assembly for supporting said slide assembly in a predetermined position relative to said second form means as said slide assembly slidingly engages said bearing plate means; and adjustment means coupled to said support assembly for adjusting the position of said slide assembly relative to said second form means.

13. A system according to claim 1, further comprising vibration means mounted adjacent said first form means for eliminating voids in wet concrete delivered to said area enclosed by said first and second form means.

14. A system according to claim 13, wherein said vibration means comprises at least one vibrator positioned proximate to said support means and at least one vibrator positioned proximate to said first form means.

15. A system according to claim 1, wherein said drive means includes:

first means for causing said first form means to move back and forth along a first axis extending perpendicular to said substantially horizontal direction; and second means for causing said first form means to move back and forth along a second axis extending perpendicular to said first axis and to said substantially horizontal direction.

16. A system for continuously forming a concrete structure which extends in a substantially horizontal direction and has a predetermined cross-sectional configuration, the system comprising:

a frame;

first form means for supporting at least a portion of a first side of the concrete structure and for forming a pattern in the outside surface of the first side comprising concave or convex portions which extend other than in a horizontal direction, said concave or convex portions forming a reverse image of a pattern to be provided on the first side of the concrete structure, said first form means including a rigid wall to support said pattern;

second form means for supporting at least a portion of an opposite side of the concrete structure and for forming a pattern on the inside of the opposite side comprising concave or convex portions which extend other than just in a horizontal direction, said concave or convex portions forming a reverse image of a pattern to be provided on the opposite side of the concrete structure, the second form means coacting with said first form means so as to enclose an area having a cross-sectional configuration corresponding to the predetermined cross-sectional configuration of the concrete structure, said second form means including a rigid wall to support pattern;

drive means coupled to said frame for causing said frame to move in the substantially horizontal direction; and support means coupled to said frame for supporting said first and second form means relative to one another as said drive means moves in said substantially horizontal direction so as to permit said first and second form means to coact with one another so as to enclose said area, said support means contacting only a portion of said rigid wall of said first and second form means.

17. A system according to claim 16, wherein said first and second form means include an elongate planar form installable so as to extend along said first direction, said first and second form means each having an inner surface and an outer surface, said inner surface of said first and second form means facing one another and said outer surface of first and second form means facing away from one another.

18. A system according to claim 17, wherein said inner surface of said first and second form means includes said convex or concave portions.

19. A system according to claim 18, wherein at least one of said convex or concave portions comprise a plurality of elongate portions, the elongate axis of said portions extend perpendicular to said substantially horizontal direction.

20. A system according to claim 18, wherein at least one of said convex or concave portions comprise a plurality of curved portions.

21. A system according to claim 18, wherein at least one of said convex or concave portions comprise a plurality of elongate portions, elongate axis of said portions extend transversely to said substantially horizontal direction.

22. A system according to claim 16, wherein said first and second form means include beating plate means attached to and forming a part of said rigid walls of said first and second form means for providing at least one continuous surface extending in said substantially horizontal direction.

23. A system according to claim 22, wherein said bearing plate means comprises two continuous, elongate members which extend in parallel in said substantially horizontal direction, said members being spaced a predetermined distance from one another.

24. A system according to claim 16, said first and second form means including bearing plate means, attached to said rigid walls of said first and second form means further wherein said support means comprise slide means for slidingly engaging said bearing plate means as said support means is caused to move in said substantially horizontal direction by said drive means.

25. A system according to claim 24, wherein said slide means comprise:

a slide assembly for slidingly engaging said bearing means;

a support assembly coupled to said frame and said slide assembly for supporting said slide assembly in a predetermined position relative to said first and second frame means as said slide assembly slidingly engages said bearing means; and adjusting means coupled to said support assembly for adjusting the position of said slide assembly relative to said first and second form means.

26. A system according to claim 16, further comprising vibration means mounted on said frame for penetrating into said concrete structure for eliminating voids in wet concrete delivered to said area enclosed by said first and second form means.

27. A system according to claim 26, wherein said vibration means comprise at least one vibrator coupled to said support means and at least one vibrator coupled to said slide means.

28. A system according to claim 16, wherein said drive means includes:

first means for causing said slide means to move back and forth along a first axis extending perpendicular to said substantially horizontal direction; and second means for causing said slide means to move back and forth along a second axis extending perpendicular to said first axis and to said substantially horizontal direction.

29. A device for slip forming a concrete structure along a substantially horizontal path, the device coatting with first and second forms which extend along the path to support, and define the configuration of both sides of, the structure, the first and second forms each having an inner surface which engages a side of the structure, the first and second forms including a pattern comprising concave or convex portions which extend other than parallel to the path, the first and second forms including rigid walls to support the pattern, the device comprising:

a frame;

drive means coupled to said frame for moving said frame along the substantially horizontal path; and support means coupled to said frame for supporting said first and second forms relative to one another as said drive means moves said frame along said path so as to cause said first and second forms to coact with one another and enclose an area that defines the cross-sectional shape of a concrete structure to be formed by said device, wherein said support means comprises slide means for slidingly engaging and supporting an outer surface of said first and second forms as said slide means is caused to move along said path by said drive means, wherein said slide means comprises at least one rail which extends parallel to the path to slidingly engage the outer surface of the form; a plurality of supports which extend transversely to, and are attached to, said at least one rail; and a support assembly attached to said plurality of supports for coupling said plurality of supports with said frame and for adjusting the position of said plurality of supports relative to said frame.

* * * * *

UNITED STATES PATENT AND TRADEMARK OFFICE

CERTIFICATE OF CORRECTION

PATENT NO. : 5,533,888

DATED : July 9, 1996

INVENTOR(S) : J.F. Belarde

It is certified that error appears in the above-indentified patent and that said Letters Patent is hereby corrected as shown below:

| COLUMN | LINE | |
|---|---|---|
| Title page, item [76] | Inventor | "SE.," should read --S.E.,-- |
| 23 (Claim 16, | 11 line 16) | After "inside" insert --surface-- |
| 23 (Claim 16, | 21 line 26) | After "support" insert --said-- |
| 23 (Claim 22, | 53 line 2) | "beating" should read --bearing-- |
| 24 (Claim 29, | 34 line 2) | "coatting" should read --coacting-- |

Signed and Sealed this

Fifth Day of August, 1997

Bruce Lehman

*Attest:*

BRUCE LEHMAN

*Attesting Officer*

*Commissioner of Patents and Trademarks*